US007878728B2

(12) United States Patent
Nasu et al.

(10) Patent No.: US 7,878,728 B2
(45) Date of Patent: Feb. 1, 2011

(54) VISCOUS COSMETIC

(75) Inventors: Mieko Nasu, Yokohama (JP); Noriko Tomita, Yokohama (JP)

(73) Assignee: Shiseido Co., Ltd., Chuo-ku (JP)

( * ) Notice: Subject to any disclaimer, the term of this patent is extended or adjusted under 35 U.S.C. 154(b) by 959 days.

(21) Appl. No.: 11/659,249

(22) PCT Filed: Nov. 18, 2004

(86) PCT No.: PCT/JP2004/017199

§ 371 (c)(1),
(2), (4) Date: Mar. 14, 2007

(87) PCT Pub. No.: WO2006/018907

PCT Pub. Date: Feb. 23, 2006

(65) Prior Publication Data

US 2007/0251541 A1 Nov. 1, 2007

(30) Foreign Application Priority Data

Aug. 17, 2004 (JP) ..... 2004-237751

(51) Int. Cl.
*B43K 1/06* (2006.01)

(52) U.S. Cl. ..... 401/265; 401/263; 401/173; 401/174

(58) Field of Classification Search ..... 401/261–267, 401/173, 174
See application file for complete search history.

(56) References Cited

U.S. PATENT DOCUMENTS

| | | | | |
|---|---|---|---|---|
| 4,887,924 | A | 12/1989 | Green | |
| 5,478,552 | A | 12/1995 | Hasegawa | |
| 5,772,347 | A | 6/1998 | Gueret | |
| 5,879,095 | A | 3/1999 | Gueret | |
| 6,238,117 | B1 | 5/2001 | Griebel et al. | |
| 6,309,128 | B1 | 10/2001 | Griebel et al. | |
| 6,746,170 | B2 * | 6/2004 | Delage | 401/266 |
| 2002/0037304 | A1 | 3/2002 | Sato | |

FOREIGN PATENT DOCUMENTS

| | | |
|---|---|---|
| JP | 1-249006 | 10/1989 |
| JP | 8-229461 | 9/1996 |
| JP | 08-229462 | 9/1996 |
| JP | 8-317818 | 12/1996 |
| JP | 10-000001 | 1/1998 |
| JP | 2000-185780 | 7/2000 |
| JP | 2002-128640 | 5/2002 |
| JP | 2002-284645 | 10/2002 |
| JP | 2003-286128 | 10/2003 |
| WO | 99/01052 | 1/1999 |

* cited by examiner

*Primary Examiner*—David J Walczak
(74) *Attorney, Agent, or Firm*—Jordan and Hamburg LLP

(57) ABSTRACT

A viscous cosmetic product that realizes smooth application thereof to application target areas and that prevents liquid dripping thereof onto a surface of a viscous cosmetic substance container and is free from stickiness at use thereof, enabling clean use thereof. A viscous cosmetic substance containing 1.0 to 10.0 wt % of silicic anhydride is accommodated in a tubular accommodation part. A front edge wall of the accommodation part is furnished with one or more distribution ports for the viscous cosmetic substance, and an application face is provided outside the front edge wall. Furthermore, the accommodation part thereinside is fitted with an inner tray that enables pressing the viscous cosmetic substance accommodated in the accommodation part so as to enable the viscous cosmetic substance to be pushed outward through the distribution ports.

11 Claims, 16 Drawing Sheets

(a)

(b)

VISCOUS COSMETIC

TECHNICAL FIELD

This invention relates to a viscous cosmetic product provided with an accommodation part for accommodating the viscous cosmetic substance containing silicic anhydride and with an application surface for applying the viscous cosmetic substance.

BACKGROUND ART

There has been an existing cosmetic substance, as described in patent documents 1 and 2, which contains silicic anhydride and is formed in a solid bar-shape in order to maintain temporary stability or to enhance a coloration, a makeup effect, or a texture altering effect at the time of application to an application target area such as lips.

However, the bar-shaped cosmetic substance has disadvantages in fragility thereof in the case of receiving an impact such as falling on a floor during storage inside a container. Furthermore, a surface of the cosmetic substance is always exposed to the air not only during application to the application target areas but also during storage inside the container, so that a surface in contact with the air gets deteriorated or the cosmetic substance becomes soft due to an increase in external temperature causing deformation such as bending during application thereof, and thus sometimes, it is difficult to apply the cosmetic substance to the application target area smoothly.

To eliminate the aforementioned disadvantages, such a method exists that a viscous cosmetic substance containing silicic anhydride, which is accommodated in a tubular accommodation part through the use of a container such as described in a patent document 3, without the use of the cosmetic substance formed in a solid bar-shape, is applied to the application target areas by means of an applicator provided together with a lid in a united manner. By this means, however, the applicator is to be disposed inside the accommodation part at the time of mounting the lid in the accommodation part after use, so that the applicator after use comes in contact with the viscous cosmetic substance inside the accommodation part, thereby rendering the viscous cosmetic substance inside the accommodation part to become easily polluted and in an unsanitary condition. The patent document 1 is Japanese Patent Laid-Open No. 2002-284645. The patent document 2 is Japanese Patent Laid-Open No. 2002-128640. The patent document 3 is Japanese Patent Laid-Open No. H8-317818.

SUMMARY OF THE INVENTION

The invention aims to solve the aforementioned problems and the objectives of the invention are to realize smooth application of a viscous cosmetic substance to the application target areas and to render the viscous cosmetic substance inside an accommodation part in a good storage condition without causing problems such as deterioration or pollution during storage, by accommodating the viscous cosmetic substance containing silicic anhydride in the tabular accommodation part and by enabling the viscous cosmetic substance to be discharged to an exterior through a distribution port formed at an front end of the accommodation part with the use of an inner tray disposed inside the accommodation part.

Furthermore, objects of the invention are to enable clean, comfortable, continuous use without fears of viscous cosmetic substance leakage due to liquid dripping even in a storage condition at high temperature and to obtain light, smooth application texture, uniform application on lips or the like, and good finished quality hardly allowing the viscous cosmetic substance to ooze from an application part at the time of application of the viscous cosmetic substance to an application target area.

To solve the aforementioned problems, a viscous cosmetic product includes an accommodation part in a tubular shape accommodating a viscous cosmetic substance containing 1.0 to 10.0 wt % of silicic anhydride, an application face formed at an outer side of a front edge wall of the accommodation part furnished with a single or plurality of distribution ports for the viscous cosmetic substance, and an inner tray for pressing the viscous cosmetic substance accommodated in the accommodation part to push the viscous cosmetic substance to an exterior through the distribution ports, the inner tray incorporated in the accommodation part.

An initial particle of silicic anhydride may have an average diameter of 5.0 to 30 nm.

The silicic anhydride may be such as having been subject to a silylation process.

The viscous cosmetic substance may have a hardness 5 to 30 as a measured value by a Rheometer at 25 degrees Celsius (Rheometer 11.3 Ø 25 degrees Celsius, manufactured by Fudo Kogyo Co., Ltd.)

The distribution port may be formed in a manner inclined to a formation axis with respect to the application face.

The distribution port has an opening at a side of the accommodation part, placed near a center of the front edge wall and an opening at a side of the application face, placed nearer the exterior in relation to the opening at the side of the accommodation part so that the viscous cosmetic substance can be radially expelled through the distribution port to the application face from the center in the external direction.

The distribution port may have an opening at the side of the application part placed near the center of the front edge wall and an opening at the side of the accommodation part, placed nearer the exterior in relation to the opening at the side of the application face so that the viscous cosmetic substance can be radially expelled through the distribution port to the application face from the exterior in the direction of the center.

This invention can realize smooth application of a viscous cosmetic substance to the application target areas and render the viscous cosmetic substance inside an accommodation part in a good storage condition without causing problems such as deterioration or pollution during storage, by accommodating the viscous cosmetic substance containing silicic anhydride in the tabular accommodation part and by enabling the viscous cosmetic substance to be discharged to an exterior through a distribution port formed at an front end of the accommodation part with the use of an inner tray disposed inside the accommodation part.

Furthermore, by rendering the viscous cosmetic substrate contain 1.0 to 10.0 wt % of silicic anhydride, this invention can enable clean, comfortable, continuous use without fears of viscous cosmetic substance leakage due to liquid dripping even in a storage condition at high temperature and obtain light, smooth application, texture, uniform application on lips or the like, and good finished quality hardly allowing the viscous cosmetic substance to ooze from an application part at the time of application of the viscous cosmetic substance to an application target area.

Figure 1:
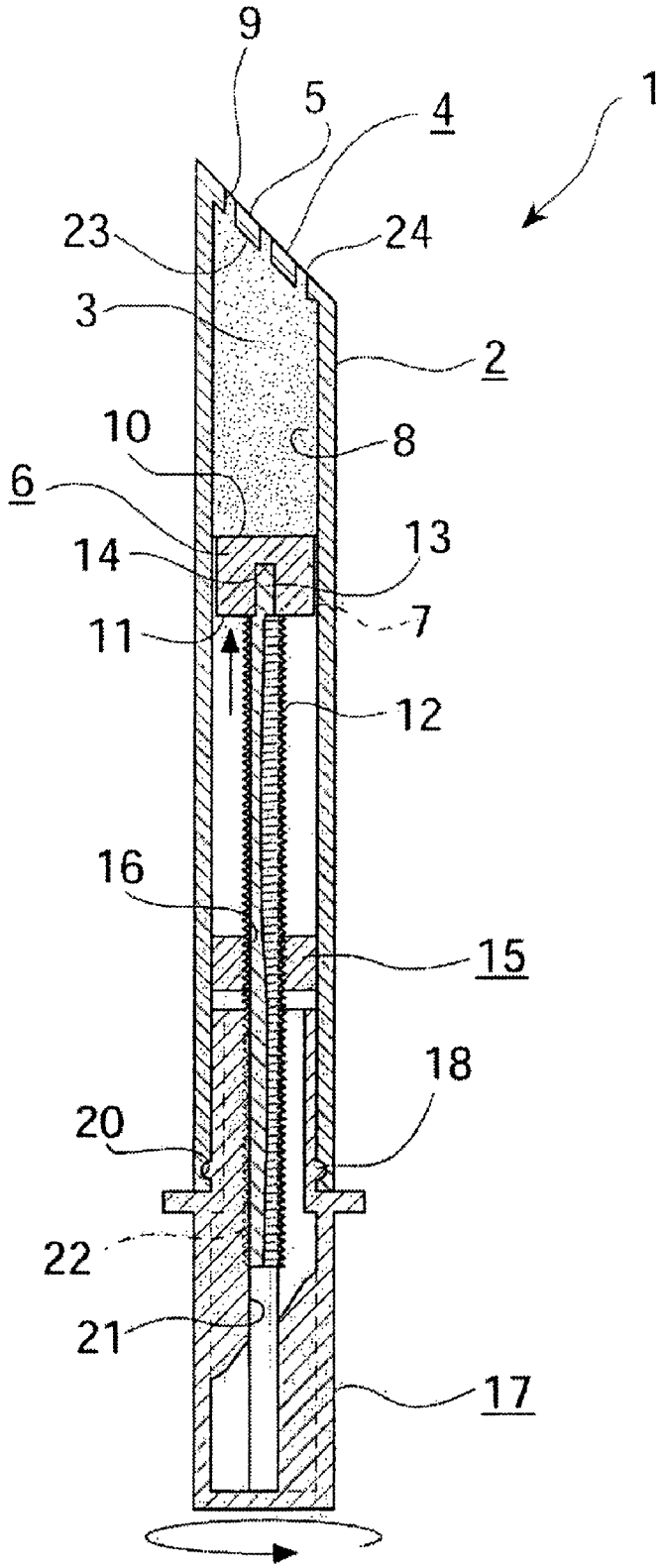
FIG. 1 is a cross-section view of a viscous cosmetic product according to a first embodiment of this invention.

| Explanation of Reference Numerals | |
|---|---|
| 2 | an accommodation part |
| 3 | a viscous cosmetic product |
| 4 | a front edge wall |
| 5 | an application face |
| 6 | an inner tray |
| 9 | a distribution passage |
| 10 | an opening |

BEST MODE FOR CARRYING OUT THE INVENTION

First Embodiment

In explaining the first embodiment of this invention with reference to FIG. 1, numeral (1) is a viscous cosmetic substance container, and a viscous cosmetic product according to the invention can be obtained by accommodating a viscous cosmetic substance (3) to be described in detail hereinafter, in an accommodation part (2) provided in the viscous cosmetic substance container (1). The accommodation part (2) is uniformly formed in an inner circumferential diameter from a front edge to a rear end thereof, in which the front edge is provided with a front edge wall (4) which is inclined perpendicularly to an axial direction of the accommodation part (2) and is formed in an oval plane shape. Therefore, a whole surface of an application face (5) can be easily brought into contact with an application subject face as an application target by holding the viscous cosmetic substance container (1) with a side of the front edge wall (4) faced up.

Figure 3:
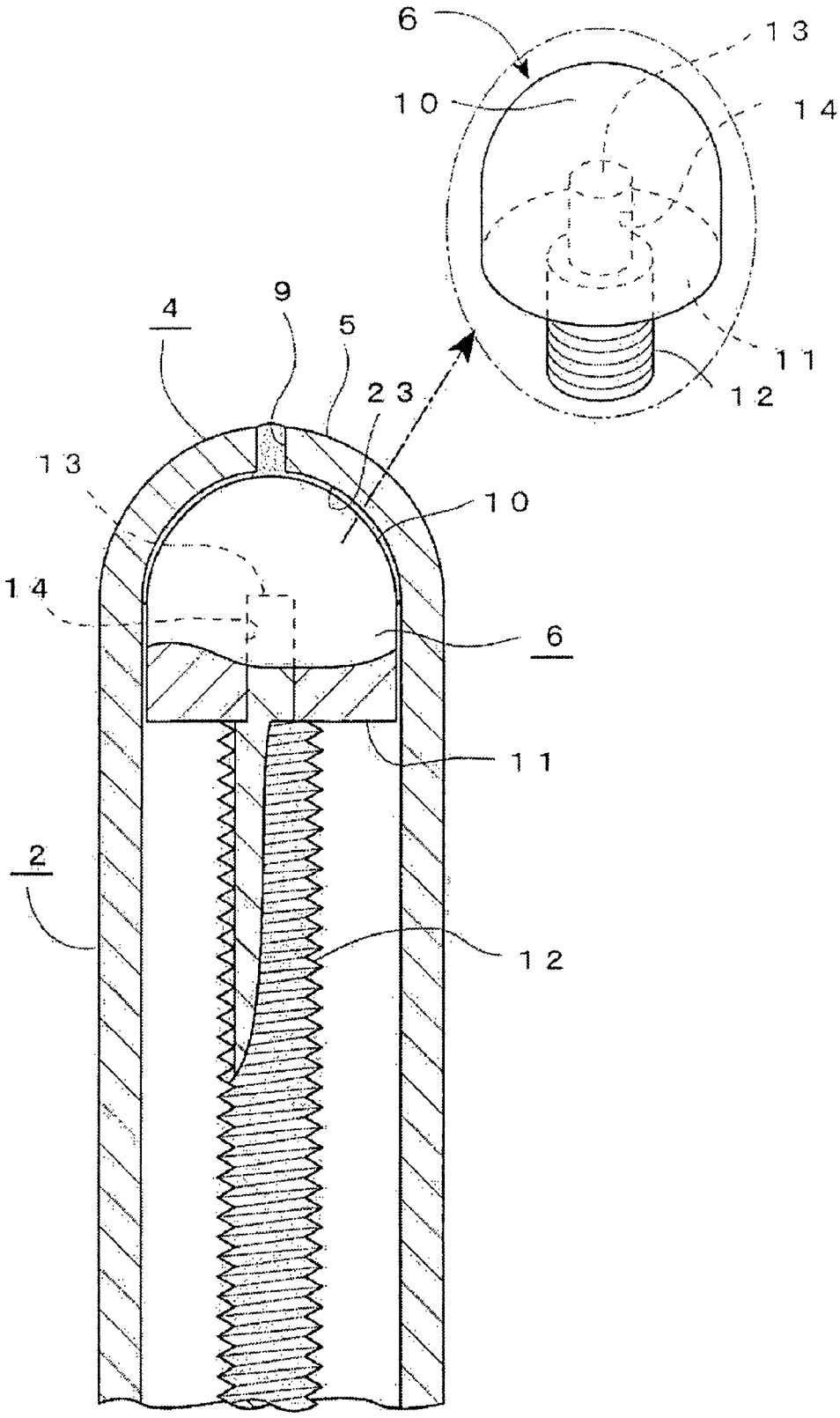
FIG. 3 is a cross-section view of a viscous cosmetic substance on completion of discharge according to a third embodiment of this invention.

Therefore, a user can apply the viscous cosmetic substance (3) to the application subject face easily and smoothly according to the intended use without such an excessive load as requiring the trouble to adjust a holding angle of the viscous cosmetic substance container (1) to bring the whole surface of the application face (5) into close contact with the application subject face. Furthermore, the front edge wall (4) is furnished with six distribution ports (9) with a diameter of 1 mm each such that a formation axis is disposed in parallel with an axial direction of the accommodation part (2), and the viscous cosmetic substance (3) accommodated in the accommodation part (2) is made dischargeable outward through the distribution ports (9). As shown in FIG. 3, the formation axis of each of the distribution ports (9) is formed in parallel with the axial direction of the accommodation axis (2), thereby being disposed in an inclined manner with respect to the application face (5).

Furthermore, as shown in FIG. 1, an inner tray (6) for pushing the viscous cosmetic substance (3) in the direction of the front edge wall (4) is disposed inside the accommodation part (2). This inner tray (6) is formed in a cylindrical shape in a slidable manner in the axial direction inside the accommodation part (2).

A bottom surface (11) of the inner tray (6) at an opposite side of an upper surface (10) at a side of the front edge wall (4) is connected to an extension bar (12) furnished with an outer circumferential spiral flute. The extension bar (12) has a fitting projection (13) that is formed in a projected manner at one end at a side of the inner tray (6). The extension bar (12) connects to the inner tray (6) in a rotatable moving manner by fitting the fitting projection (13) into a fitting receiver (14) formed at a center of the bottom surface (11) of the inner tray (6). Furthermore, the extension bar (12) has a formation length enough to move the inner tray (6) up to the front edge wall (4) at the time that the extension bar (12) connects to the inner tray (6) to become incorporated into the accommodation part (2).

Furthermore, a feeding ring (15) for feeding the extension bar (12) in the direction of the front edge is provided perpendicularly to the axial direction at a side of the rear end inside the accommodation part (2). This feeding ring (15) is secured immovably to an inner circumferential surface of the accommodation part (2) and has a puncture (16) in a center of the feeding ring (15). The puncture (16) has an inner circumferential surface thereof furnished with an inner circumferential spiral flute, which can fit in the outer circumferential spiral flute, and the extension bar (12) is incorporated into the accommodation part (2) in a condition where the outer circumferential spiral flute fits in the inner circumferential spiral flute.

As shown in FIG. 1, the rear end of the accommodation part (2) is provided with a rotating body (17) separate from the accommodation part (2). An engagement projection (18) is formed in a projected manner at an outer circumferential surface of the rotating body (17) at a side of the accommodation part (2). The rotating body (17) is rotatably connected to the accommodation part (2) in a fixed position by engaging the engagement projection (18) in a cyclic engagement receiver (20) formed at the inner circumferential surface of the accommodation part (2) at a side of the rear end.

Furthermore, an engaging piece (21) is provided in a projected manner in the axial direction at the inner circumferential surface of the rotating body (17). An engaging concave flute (22), which can fit with the engaging piece (21), is formed in the axial direction at an outer circumferential surface of the extension bar (12), and the viscous cosmetic substance container (1) has a structure such that the engaging piece (21) fits in the engaging concave flute (22) to rotate the extension bar (12) together with the rotating body (17) in a united manner at the time of rotation of the rotating body (17). The extension bar (12) is incorporated in the rotating body (17) slidably in the axial direction by providing a gap between the engaging piece (21) and the engaging concave flute (22).

The accommodation part (2) is made of an opaque material to have a structure such that the viscous cosmetic substance (3) accommodated in the accommodation part (2) is not affected by ambient light. Therefore, deterioration of the quality of the viscous cosmetic substance (3), such as quality alteration or degradation due to ambient light, can be prevented. In addition, a lip gloss is used as the viscous cosmetic substance (3) in this embodiment and the subsequent embodiments. Furthermore, a sealing member (not shown) formed in a sheet shape is removably attached to the application face (5) to close the distribution port (9).

With respect to the viscous cosmetic substance container (1) structured as described above, a method of discharging the viscous cosmetic substance (3) accommodated in the accommodation part (2) is explained hereinafter. First, the sealing member is removed from the application face (5) and the rotating body (17) is rotated in one direction to rotate the extension bar (12) engaged in the rotating body (17). In association with this rotation, the extension bar (12) is fed in the direction of the front edge by the inner circumferential spiral flute of the feeding ring (15) in which the outer circumferential spiral flute fits. At this time, the extension bar (12) is moved smoothly in the direction of the front edge because of its engagement in the rotating body (17) in a manner slidable in the axial direction independently from the rotating body (17). In association with this movement of the extension bar (12), the inner tray (6), which is provided at one end of the extension bar (12) at a side of the front edge, is moved in the direction of the front edge, so that the viscous cosmetic substance (3) accommodated in the accommodation part (2) is pushed in the direction of the front edge wall (4) by the inner tray (6), thereby being discharged outward through the distribution ports (9) in the application face (5). The viscous cosmetic substance (3) can be applied on the application target area such as a lip or the like by discharging the necessary amount of the viscous cosmetic substance (3) through the distribution ports (9), as described above.

With respect to the viscous cosmetic product as described above, in the case of excessively high hardness of the viscous cosmetic substance (3), generally, the viscous cosmetic substance (3) is barely discharged through the distribution ports (9) or spread over the application target area because of high application resistance and a moist feeling and the like during use becomes poor. Conversely, in the case of too low hardness of the viscous cosmetic substrate (3), the viscous cosmetic substrate (3) oozes from the application target area at the time of application to the application target area or easily leaks from the distribution ports (9) (in another words, liquid dripping) during use. Furthermore, in the case of an increase in external temperature during storage, a hardness of the viscous cosmetic substance (3) becomes low to easily cause the liquid dripping.

Those problems can be solved by blending 1.0 to 10.0 wt % of silicic anhydride into the viscous cosmetic substance (3). Thus, blending examples of the viscous cosmetic substance containing 1.0 to 10.0 wt % of silicic anhydride are described as blending examples 1 to 4. Those blending examples 1 to 4 may be applied to the first embodiment as structured in the manner described above, or may be used in application for the viscous cosmetic product by application of the blending examples 1 to 4 to the cosmetic substance container (1) described in the second to tenth embodiments to be described later. In addition, silylation silic anhydride, which has a hydrophobic property by a silylation process, is used as silic anhydride used in the blending examples hereinafter, and formulation examples of the viscous cosmetic substance (3) are listed in the blending examples 1 to 4 in Table 1 below.

The blending examples 1 and 2 are blended with dextrin palmitate ester as a fixing agent (hereinafter, referred to as a K-base), and the blending example 3 is blended with microcrystalline wax as a fixing wax (hereinafter, referred to as a W-base). The blending example 4 is blended with both of dextrin palmitate ester and microcrystalline wax (hereinafter, referred to as a combined-use-base). In Table 1, the viscous cosmetic substances (3) blended with no silylation silic anhydride are set to comparative examples 1, 3, 4, and 6 while the viscous cosmetic substances (3) blended with 0.5% of silylation silic anhydride and 12% silylation silic anhydride are set to comparative examples 2 and 5, respectively. The comparative examples of K-base, which correspond to the blending examples 1 and 2, are set to the comparative examples 1 and 2; the comparative examples of W-base, which correspond to the blending example 3, are set to the comparative examples 3, 4, and 5; and the comparative example of combined-use-base, which corresponds to the blending example 4, is set to the comparative example 6.

In the blending examples 1 to 4 and the comparative examples 1 to 6, deodorization polybutene, liquid paraffin, malate diisostearyl, and castor oil are used as oil contents added to the viscous cosmetic substance (3). Furthermore, Red No. 202 is used as a coloring agent while dipropylene glycol and ethyl paraben are used as an antiseptic agent.

Table 1 below provides measured results with respect to the hardness of the viscous cosmetic substance (3) of each of the blending examples 1 to 4 and the comparative examples 1 to 3, which is measured by a Rheometer (NMR-3002D manufactured by Fudo Kogyo Co., Ltd., with a needle of 3 mm with a diameter of 11.3 mm) in an atmosphere of 25 degrees Celsius. Other than the hardness, Table 1 provides measured results with respect to fit feeling, smoothness, an assessment as to oozing, an assessment as to time-lag, and stability at 50 degrees Celsius.

The fit feeling and the smoothness are sensory assessment by a human subject at the time of application of each viscous cosmetic substance (3) to the application target area of the human subject. The assessment as to oozing indicates assessment as to how much the viscous cosmetic substance (3) is spread outward from an application region at the time of application of the viscous cosmetic substance (3) to the application target area. Those assessments are made by five female subjects at an average age of 27 years old and obtained upon application of the viscous cosmetic substance (3) of each of the comparative examples and the blending examples to the lips.

In Table 1, a numerator with respect to fit feeling describes the number of people who said they felt excellent fit feeling;

a numerator with respect to smoothness describes the number of people who said they felt excellent smoothness; and a numerator with respect to an assessment as to oozing describes the number of people who said the viscous cosmetic substance (3) does not ooze. Meanwhile, a denominator describes the total number of subjects.

Furthermore, the assessment as to time-lag is an assessment as to whether the viscous cosmetic substance (3) is instantly discharged at the time of discharge of the viscous cosmetic substance (3) through six distribution ports (9) having a diameter of 1 mm and a formation axis thereof formed perpendicularly to the application face (5). The aforementioned human subjects gave an assessment of "very good" to the viscous cosmetic substance (3) which is instantly discharged for sure; an assessment of "good" to the viscous cosmetic substance (3) which is comparatively instantly discharged; an assessment of "average" to the viscous cosmetic substance (3) which the human subjects cannot confidently decide whether the viscous cosmetic substance (3) is instantly discharged or not; and an assessment of "poor" to the viscous cosmetic substance (3) which is not discharged instantly.

Stability at 50 degrees Celsius indicates an assessment made by the inventors as to the viscous cosmetic substance (3) by confirming a liquid dripping thereof through the distribution ports (9) after letting the viscous cosmetic substance (3) stand round the clock at 50 degree Celsius in a condition where the cosmetic substance container (1) according to the first embodiment, which has the viscous cosmetic substance container (1) filled with each viscous cosmetic substance (3), is transversely placed. The inventors gave an assessment of "very good" to the viscous substance (3) which is very stable; an assessment of "good" to the viscous cosmetic substance (3) which is comparatively stable; an assessment of "average" to the viscous cosmetic substance (3) which the inventors cannot confidently decide whether the viscous cosmetic substance (3) is stable or not; and an assessment of "poor" to the viscous cosmetic substance (3) which is not stable.

TABLE 1

| | | K-base | | | |
|---|---|---|---|---|---|
| | | comparative example 1 | comparative example 2 | blending example 1 | blending example 2 |
| | dextrin palmitate ester (wt %) | 4 | 4 | 2 | 4 |
| | microcrystalline wax (wt %) | — | — | — | — |
| | silic anhydride (wt %) | — | 0.5 | 5 | 3 |
| oil content | deodorization polybutene | (40) | (40) | −30 | (40) |
| | liquid paraffin | (5) | (27.35) | (36.8) | (24.85) |
| | malate diisostearyl | (44.8) | (20) | (20) | (20) |
| | castor oil | (5) | (5) | (5) | (5) |
| | subtotal (wt %) | 94.8 | 92.35 | 91.8 | 89.85 |
| | Red No. 202 | 0.05 | 2 | 0.05 | 2 |
| antiseptic agent | dipropylene-glycol | (1) | (1) | (1) | (1) |
| | ethyl paraben | (0.15) | (0.15) | (0.15) | (0.15) |
| | subtotal (wt %) | 1.15 | 1.15 | 1.15 | 1.15 |
| | total (wt %) | 100 | 100 | 100 | 100 |
| | hardness (Rheomater with 11.3Ø, 3 mm, and 25° C. needle) | 18 | 13 | 10 | 10 |
| assessment | fit feeling | 2/5 | 2/5 | 4/5 | 4/5 |
| | smoothness | 3/5 | 3/5 | 2/5 | 3/5 |
| | oozing assessment | 0/5 | 1/5 | 5/5 | 4/5 |
| | time-lag assessment (discharge assessment) | good | good | good | good |
| | stability at 50 degrees Celsius | poor | poor | good | good |
| hardness | before discharge | 18 | 13 | 21 | 10 |
| | right after discharge | 2 | 0 | 0 | 0 |
| | left two hours after discharge. | 0 | 2 | 12 | 7 |

| | | W-base | | | | combined use | |
|---|---|---|---|---|---|---|---|
| | | comparative example 3 | comparative example 4 | blending example 3 | blending example 5 | comparative example 6 | blending example 4 |
| | dextrin palmitate ester (wt %) | — | — | — | — | 2 | 2 |
| | microcrystalline wax (wt %) | 10 | 5 | 3 | 3 | 10 | 2.5 |
| | silic anhydride (wt %) | — | — | 5 | 12 | — | 5 |
| oil content | deodorization polybutene | (40) | (40) | (40) | (40) | (40) | (40) |
| | liquid paraffin | (5) | (5) | (23.85) | (16.85) | (19.85) | (24.25) |
| | malate diisostearyl | (38.8) | (43.8) | (20) | (20) | (20) | (20) |
| | castor oil | (5) | (5) | (5) | (5) | (5) | (5) |
| | subtotal (wt %) | 88.8 | 93.8 | 88.85 | 81.85 | 84.85 | 85.85 |
| | Red No. 202 | 0.05 | 0.05 | 2 | 2 | 2 | 0.1 |
| antiseptic agent | dipropylene-glycol | (1) | (1) | (1) | (1) | (1) | (1) |
| | ethyl paraben | (0.15) | (0.15) | (0.15) | (0.15) | (0.15) | (0.15) |
| | subtotal (wt %) | 1.15 | 1.15 | 1.15 | 1.15 | 1.15 | 1.15 |
| | total (wt %) | 100 | 100 | 100 | 100 | 100 | 100 |
| | hardness (Rheomater with 11.3Ø, 3 mm, and 25° C. needle) | 91 | 22 | 13 | 25 | 3 | 14 |

TABLE 1-continued

| | | | | | | | |
|---|---|---|---|---|---|---|---|
| assessment | fit feeling | 4/5 | 2/5 | 4/5 | 2/5 | 3/5 | 4/5 |
| | smoothness | 5/5 | 3/5 | 2/5 | 0/5 | 4/5 | 3/5 |
| | oozing assessment | 4/5 | 0/5 | 5/5 | 3/5 | 1/5 | 4/5 |
| | time-lag assessment (discharge assessment) | poor | good | good | average | good | good |
| | stability at 50 degrees Celsius | poor | poor | good | good | poor | good |
| hardness | before discharge | 91 | 22 | 13 | 126 | 3 | 14 |
| | right after discharge | 0 | 0 | 9 | 48 | 0 | 3 |
| | left two hours after discharge. | 4 | 1 | 11 | 73 | 0 | 8 |

According to the experimental result presented in Table 1, with respect to the results of hardness and a time-lag assessment using the comparative examples 1 to 6, the comparative examples 1, 2, 4, 5, and 6 resulted in high hardness but did not cause time-lag in association with discharge though the distribution ports (9) while the comparative example 3 resulted in high hardness and caused time-lag in association with discharge though the distribution ports (9). On the other hand, the blending examples 1 to 4 according to this invention, containing silic anhydride resulted in low hardness and did not cause time-lag in association with discharge though the distribution ports (9), thereby enabling smooth discharge. Therefore, it turned out that the viscous cosmetic substance (3) according to the blending examples 1 to 4 is easily discharged through the distribution port (9) to the application face (5) and is a product which can be pushed out not thickly but uniformly over a wide area of the application face (5).

With respect to stability at 50 degrees Celsius, the comparative examples 1, 2, 3, 4, and 6 caused liquid dripping due to a decrease in viscosity after discharge. Furthermore, the comparative example 5 resulted in good stability at 50 degrees Celsius since a large amount of silic anhydride is added in all ingredients of the viscous cosmetic substance. On the other hand, all of the blending examples 1 to 4 barely caused liquid dripping after discharge and showed good stability without the decrease in viscosity even at high temperature.

With respect to the results of sensory assessment, the comparative examples 1, 4, and 6 with low hardness out of the comparative examples 1, 3, 4, and 6 containing no silic anhydride resulted in good fit feeling and smoothness but oozed conspicuously due to low hardness. Furthermore, the viscous cosmetic substance (3) according to the comparative example 3 has high hardness, thereby being subject to application of friction resistance at the beginning of application to the lip but achieves soft, smooth application texture and does not ooze at the end of application because of the thixotropic nature of microcrystalline wax.

With respect to the comparative examples 2 and 5 containing slilic anhydride, the viscous cosmetic substance according the comparative example 2 contained the relatively small amount of slilic anhydride, thereby resulting in good smoothness but conspicuous oozing. The comparative example 5 contained the relatively large amount of slilic anhydride, resulting in the relatively small amount of oil and small oozing but could not obtain good results for fit feeling and smoothness. On the other hand, the blending examples 1 to 4 were different from the comparative examples 3 and 5 in obtaining a good finished quality such as great smoothness and fit feeling with almost no oozing.

In accordance with the above results, the viscous cosmetic substance (3) contains 1.0 wt % to 10.0 wt % of silicic anhydride, thereby becoming soft enough to easily discharge from the distribution ports (9) and at the same time, being able to continue clean, comfortable usability without concerns for leakage due to liquid dripping even in a storage condition at high temperature. Furthermore, at the time of application of the viscous cosmetic substance (3) to the application target area such as lips, the viscous cosmetic substance (3) can realize a light, smooth application texture while being uniformly applied over the whole of the lip, resulting in a good finished quality hardly causing oozing.

Therefore, usage of the viscous cosmetic substance (3) according to the blending examples 1 to 4 in a condition of accommodation in the accommodation part (2) of the viscous cosmetic substance container (1) makes it possible to obtain a good finished quality superior in sense of beauty in association with usability realizing smoothness and great fit feeling all the way with almost no oozing.

Furthermore, Table 1 presents results of hardness recovery tests of each viscous cosmetic substance (3) according to the blending examples 1 to 4 and the comparative examples 1 to 6. This hardness recovery test is such that recovery degrees of the viscous cosmetic substance (3) is checked by measuring hardness of the viscous cosmetic substance (3) before discharge, right after discharge, and at the time of being left for two years after discharge using the Rheometer at 25 degrees Celsius.

According to Table 1, the viscous cosmetic substance (3) decreased in hardness right after discharge in all of the blending examples and comparative examples but increased in hardness in the blending examples 1 to 4, at the time of being left for two hours after discharge more than that right after discharge, in which significant recovery was observed especially in the blending examples 1 and 2. On the other hand, with respect to the comparative examples 1, 3, 4 and 6 not containing silicic anhydride, the comparative examples 1 and 6 did not recover hardness at all at the time of being left for two hours after discharge, and the comparative examples 3 and 4 slightly increased in a value of hardness but stayed low in degree of hardness recovery compared with hardness before discharge.

The comparative example 2 containing silicic anhydride slightly increased in a value of hardness but degree of hardness recovery was very low compared with the blending examples 1 and 2 in the same K-base since the viscous cosmetic substance (3) according to the comparative example 2 contained the relatively small amount of silicic anhydride. Based on those results, it turned out that hardness of the viscous cosmetic substance (3) after discharge recovers to some extent by making the viscous cosmetic substance (3) contain 1.0 wt % to 10.0 wt % of silicic anhydride.

The viscous cosmetic substance (3) according to the comparative example 5, furthermore, contains the relatively large added amount of 1.0 wt % to 10.0 wt % of silicic anhydride, thereby resulting in very high hardness, so that a value of hardness is high compared with the other examples even though hardness decreases right after discharge, thereby making it difficult to discharge the viscous cosmetic substance (3).

According to this result, in the case where silicic anhydride is not added to the viscous cosmetic substance or where the additive amount is less than 1.0 wt %, the hardness which decreased after discharge hardly recovers, thereby causing liquid dripping around the distribution ports (9) after discharge, and thus a surface of the viscous cosmetic substance container (1) gets sticky or the like due to this liquid dripping to cause discomfort to the user as well as to make the viscous cosmetic substance container (1) dirty. Furthermore, in the case where the added amount of silicic anhydride is more than 10.0 wt %, the viscous cosmetic substance (3) is high in hardness even after discharge, thereby having difficulty discharging.

On the other hand, the viscous cosmetic substance (3) is made to contain 1.0 wt % to 10.0 wt % of silicic anhydride, thereby retaining hardness to an extent to which the viscous cosmetic substance (3) does not flow out of the distribution ports (9) even in the case of increase in external temperature during storage inside the accommodation part (2). This viscous cosmetic substance (3) temporarily decreases in hardness at the time of discharge but recovers in hardness to some extent right after discharge, thereby barely causing liquid dripping around the distribution ports (9) after discharge as well as being able to prevent oozing to the application target area after application. Furthermore, as long as the contained amount of silicic anhydride is in a range of 1.0 wt % to 10.0 wt %, hardness of the viscous cosmetic substance (3) does not significantly increase, so that the viscous cosmetic substance (3) contained in the accommodation part (2) can be discharged smoothly. Therefore, the user enables clean, comfortable use while an enduring quality of the viscous cosmetic substance (3) applied to the application target area can be improved.

Second Embodiment

Figure 2:
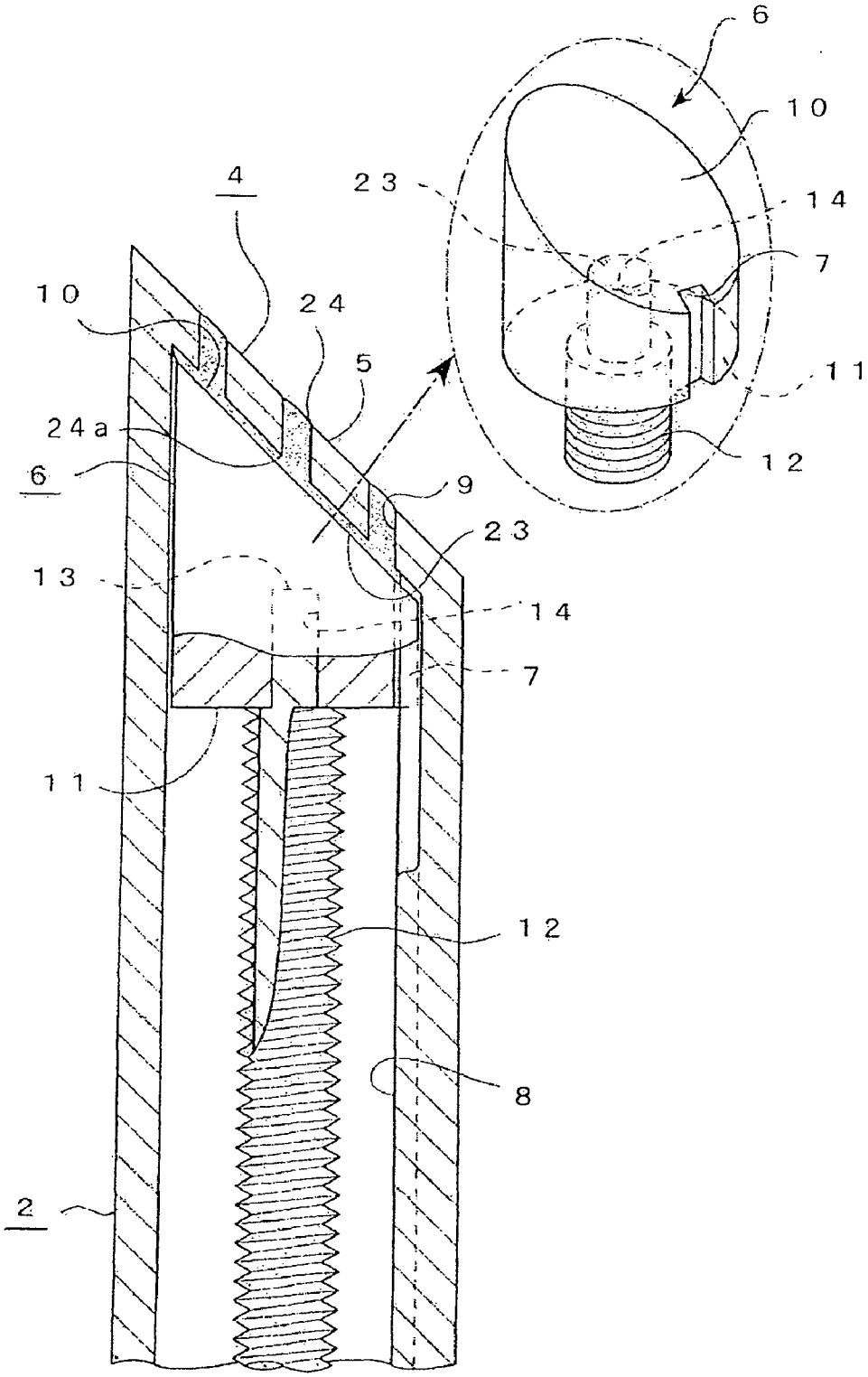
FIG. 2 is an enlarged cross-section view of a front edge of a viscous cosmetic substance on completion of discharge according to a second embodiment of this invention.

In the first embodiment, the inner tray (6) is formed in a cylinder shape in a manner to have a flat surface perpendicular to the axial direction at a side of the front edge, but in the second embodiment, the inner tray (6) is formed in a cylinder shape as shown in FIG. 2, in a manner to enable the upper surface (1) of the inner plate (6) at a side of the front edge wall (4) to be in contact with the inner surface of the front edge wall (4) by having the upper surface (10) inclined at the angle of inclination of the front edge wall (4) so a front edge shape of the inner plate (6) correspond to an inner surface shape of the front edge wall (4) of the accommodation part (2).

In the second embodiment, furthermore, the inner plate (6) is furnished with one key flute (7) in a lateral axial direction while a fitting piece (8), which can fit in the key flute (7), is provided in a manner projecting in an axial direction to an inner circumferential surface of the accommodation part (2). The inner tray (6) is incorporated into the accommodation part (2) by fitting the fitting piece (8) in the key flute (7), so that the inner tray (6) can slide only in an axial direction without rotatably moving in a circumferential direction inside the accommodation part (2).

Therefore, the key flute (7) and the fitting piece (8) is previously formed and disposed at the time of manufacturing to the inner plate (6) and the accommodation part (2), respectively, at a location where the front edge shape of the inner tray (6) corresponds to the inner surface shape of the front edge wall (4), thereby enabling the upper surface (10) of the inner tray (6) to contact with an inner surface (23) of the front edge wall (4).

The viscous cosmetic substance container (1) is formed as described above to move the inner tray (6) in the direction of the front edge in a manner to push the viscous cosmetic substance (3) in use, thereby eventually rendering the upper surface (10) of the inner tray (6) in contact with the inner surface (23) of the front edge wall (4) as shown in FIG. 2, so that the whole amount of the viscous cosmetic substance (3) accommodated in the accommodation part (2) can be discharged through the distribution ports (9) to the exterior. Therefore, the whole amount of the viscous cosmetic substance (3) accommodated in the accommodation part (2) can be used, thereby enabling economical use.

In the second embodiment, to enable the inner surface (23) of the front edge wall (4) formed in an inclined manner in the axial direction to reliably come into contact with the upper surface (10) of the inner tray (6), the inner tray (6) is prevented from rotatably moving in the circumferential direction by fitting the fitting piece (8) formed in a projected manner to the inner circumferential surface of the accommodation part (2) in the key flute (7) formed to the inner tray (6). The inner tray (6), however, may be formed in a rotatable manner in the circumferential direction without forming the key flute (7), the fitting piece (8), and the like.

In such as case, in the final stage of the viscous cosmetic substance (3) usage, in the case of displacement between the upper surface (10) of the inner tray (6) and the inner surface (23) of the front edge wall (4), the inner tray (6) hits some midpoint of the front edge wall (4), thereby being prevented from moving. However, the inner tray (6) moves in the direction of the front edge while rotating in the circumferential direction by strongly moving the rotating body (17) in a rotatable manner, thereby gradually correcting a position of the inner tray (6) to render the upper surface (10) of the inner tray (6) in contact with the inner surface (23) of the front edge wall (4) so the viscous cosmetic substance (3) as to be used without waste. The key flute (7) or the fitting piece (8) is not formed as described above, so that hermeticity between the accommodation part (2) and the inner tray (6) can be improved while manufacturing is facilitated to enable manufacturing costs to be held down.

Third Embodiment

In the first and second embodiments as described above, the accommodation part (2) is made of opaque material to avoid influence from ambient light but in this embodiment, the accommodation part (2) is made of transparent material to allow an interior of the accommodation part (2) to be seen through a casing such that the remaining amount of the viscous cosmetic substance (3) inside the accommodation part (2) after use can be easily confirmed from an exterior view.

Therefore, the user can estimate how much of the viscous cosmetic substance (3) remains until it is used up, thereby being able to prevent such a problem that the viscous cosmetic substance (3) runs out in the middle of use. Furthermore, the user can easily confirm that the whole amount of viscous cosmetic substance (3) accommodated in the accommodation part (2) is used and feel the satisfaction that economical use is completed at the point that the upper surface (10) of the inner tray (6) comes in contact with the inner surface (23) of the front edge wall (4). Additionally, the accommodation part (2) is made of transparent material in this embodiment, so that the viscous cosmetic substance container (1) is desirably accommodated in an opaque bag or box at times other than used.

Figure 8:
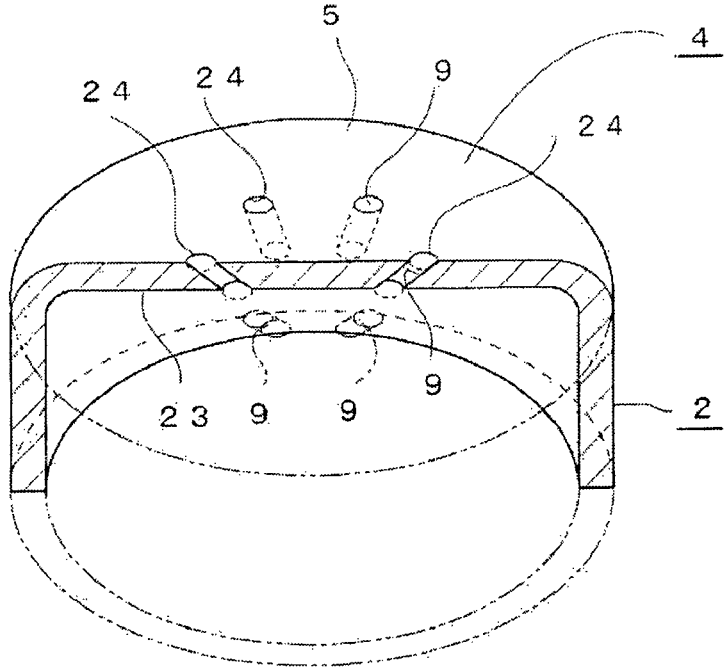
FIG. 8(*a*) is an enlarged perspective cross-section view of a front edge wall part and FIG. 8(*b*) is a plan view showing a state of discharging the viscous cosmetic substance through a distribution port according to FIG. 7.
Figure 8:
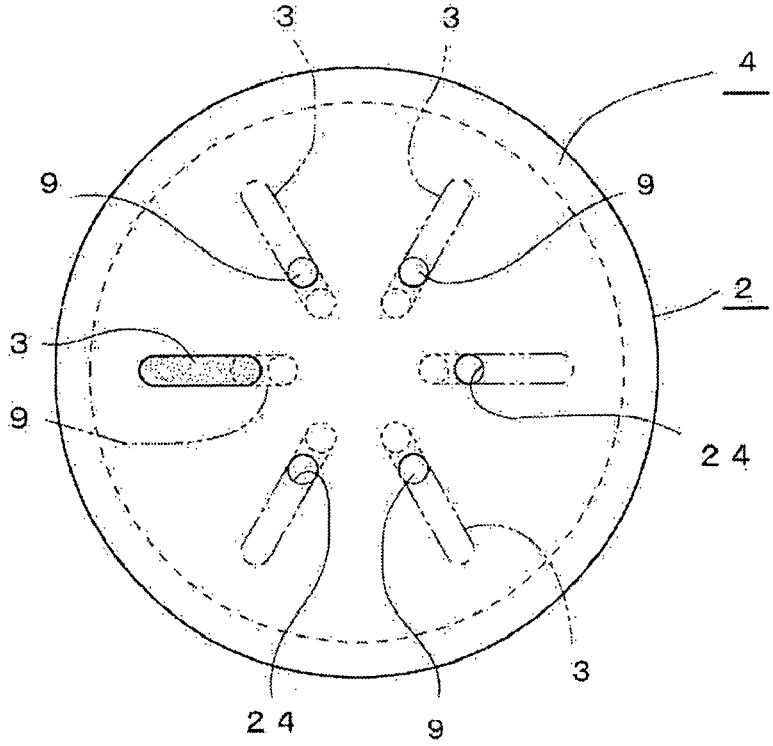

The front edge wall (4) is formed perpendicularly to the axial direction of the accommodation part (2) in the first embodiment as described above while being formed in an inclined manner perpendicularly to the axial direction of the accommodation part (2) in the second embodiment. In the third embodiment, however, the front edge wall (4) is formed in a dome shape as shown in FIG. 8. The front edge wall (4) and a boundary between the front edge (4) and the accommodation part (2) are all formed of a curved surface, so that the viscous cosmetic substance (3) can be applied over the application target area smoothly without damaging a skin of the application target area.

Furthermore, in this embodiment also, the upper surface (10) of the inner tray (6) comes in close contact with the inner surface (23) of the front edge wall (4) in a manner similar to the second embodiment in the case of moving the inner tray (6) in the direction of the front edge, by forming the front edge shape in a dome shape corresponding to the inner surface shape of the front edge wall (4). Yet further, a center of the front edge wall (4) is provided with one distribution port (9) with a diameter of 1 mm.

Fourth Embodiment

Figure 4:
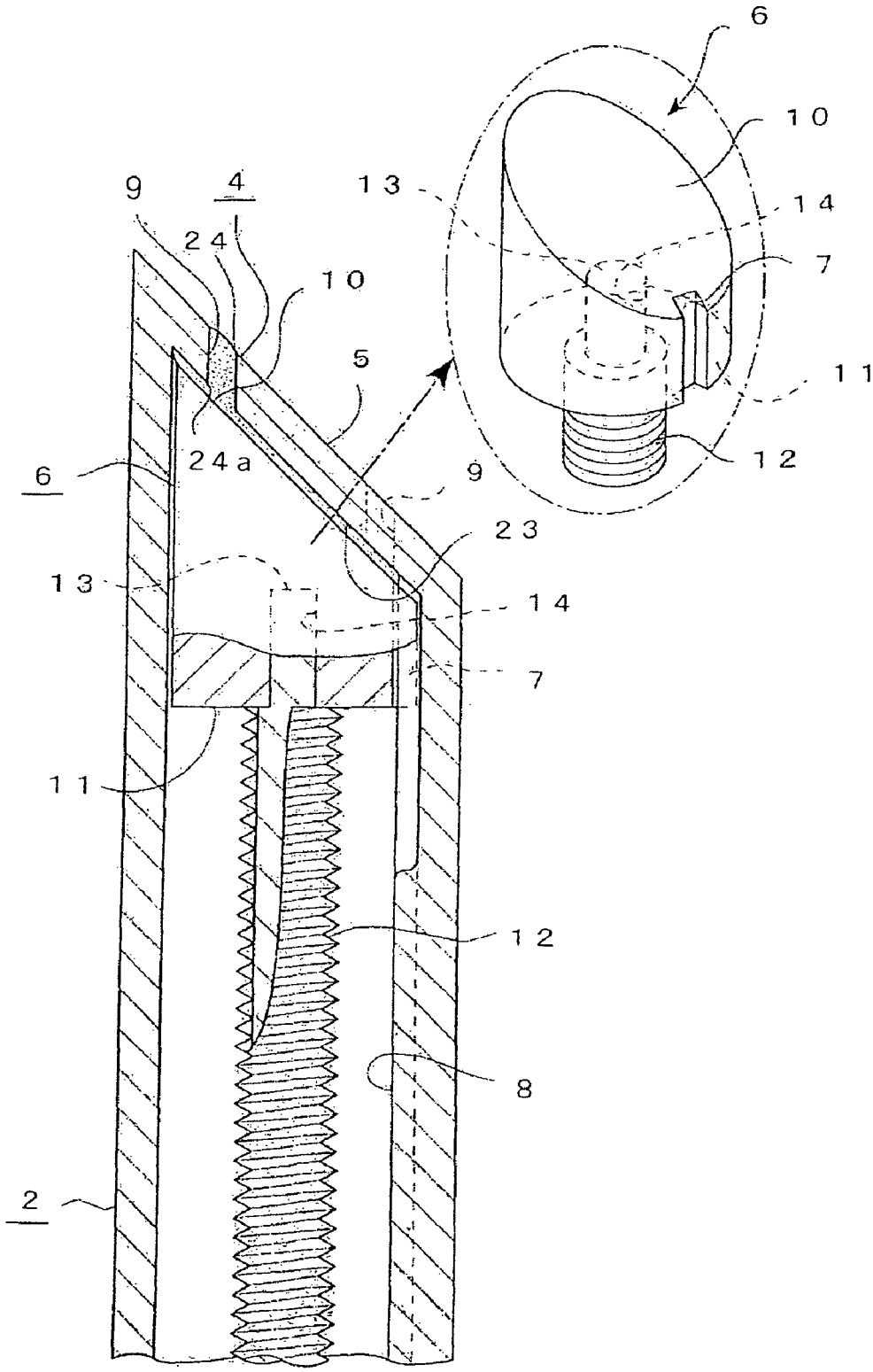
FIG. 4 is a cross-section view of a viscous cosmetic substance on completion of discharge according to a fourth embodiment of this invention.
Figure 5:
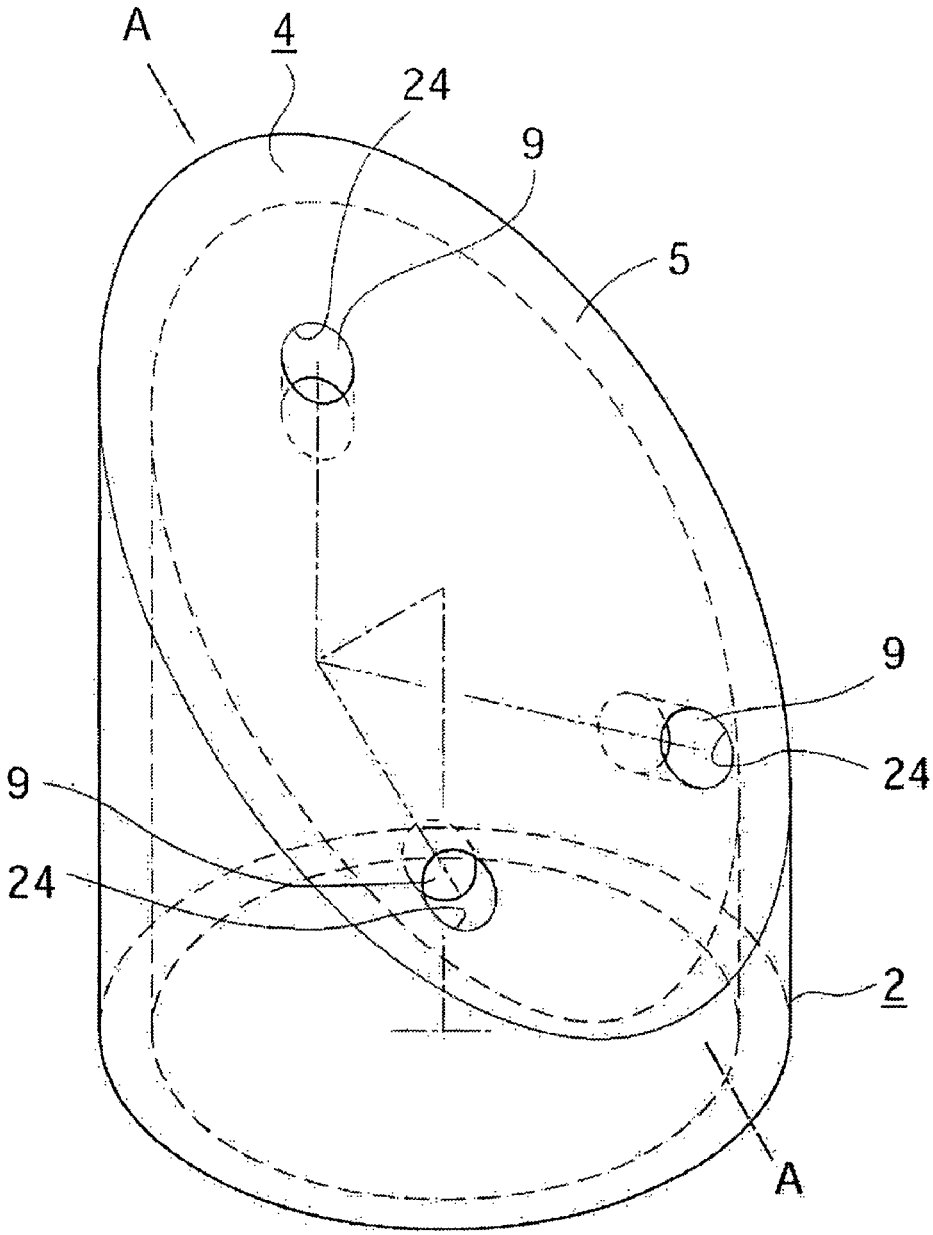
FIG. 5 is a partially-enlarged perspective view of an accommodation part according to the fourth embodiment.
Figure 6:
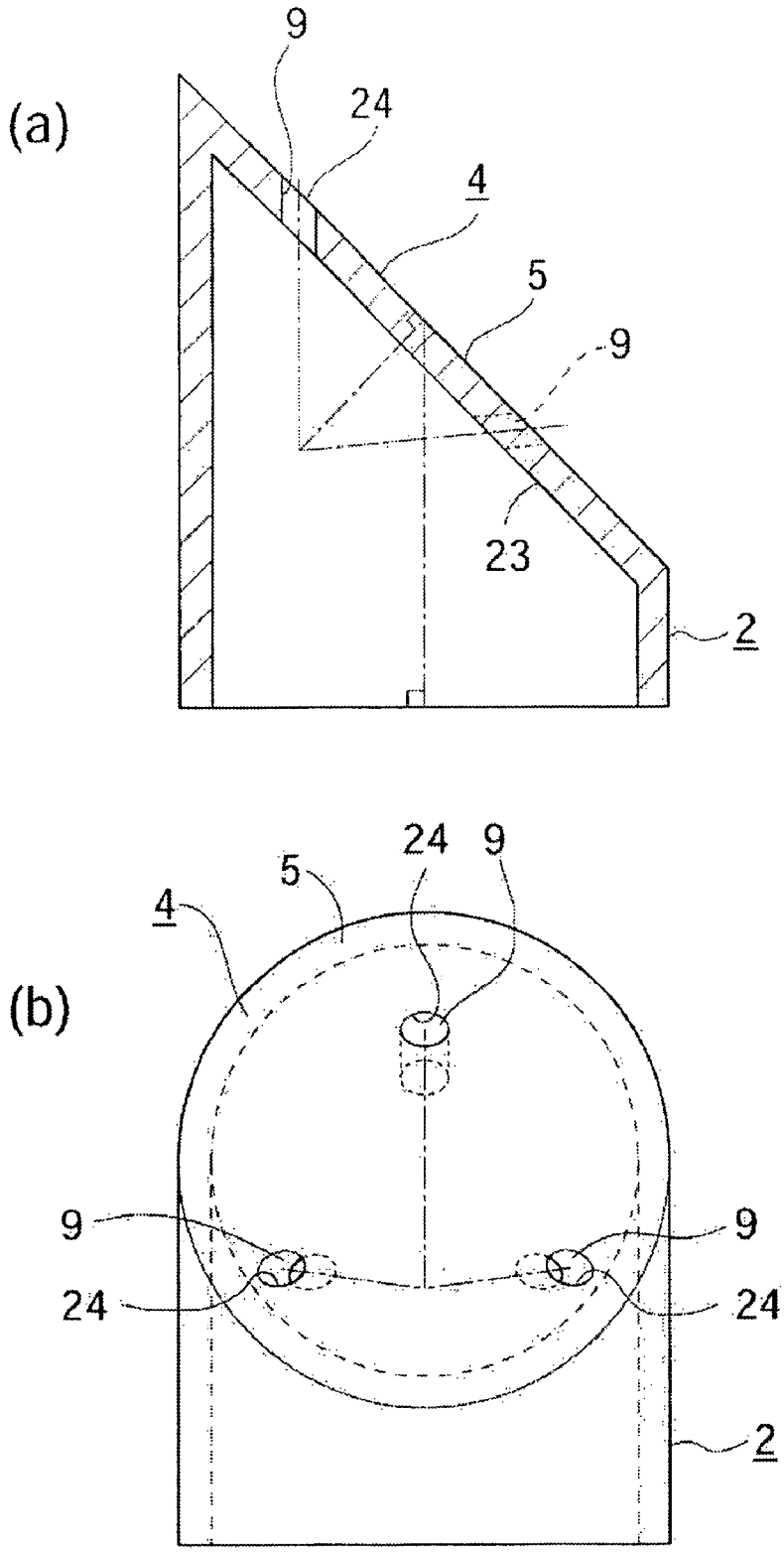
FIG. 6(*a*) is a cross-section view of FIG. 5 along the line A-A and FIG. 6(*b*) is a front view of FIG. 5.

Next, other different embodiments will be explained with reference to FIGS. 4 to 6, in which the application face (5) is inclined with respect to the axial direction of the accommodation part (2). In the fourth embodiment, the accommodation part (2), the inner tray (5), a sliding mechanism thereof, and the like are formed in a manner similar to the second embodiment, and the application face (5) is formed in an inclined manner with respect to the axial direction of the accommodation part (2). The distribution port (9) is formed in a manner to incline a formation axis with respect to the application face (5) in the second embodiment while being formed in parallel with the axial direction of the accommodation part (2) herein.

On the other hand, in this embodiment, the distribution port (9) is formed by inclining the formation axis thereof with respect to not only the axial direction of the accommodation part (2) but also with respect to the axial direction of the accommodation part (2). Furthermore, the front edge wall (4) is provided with three distribution ports (9) while an opening (24) at a side of the accommodation part (2) is placed near the center of the front edge wall (4) and an opening (24) at a side of the application face (5) is placed nearer an exterior in relation to the opening (24) at a side of the accommodation part (2), so that three distribution ports (9) are radially opened from a side of the accommodation part (2) to a side of the application face (5).

In the viscous cosmetic substance container (1) according to the second embodiment structured as described above, where the inner tray (6) in a tubular shape is slid, the viscous cosmetic substance (3) accommodated in the accommodation part (2) is pushed in the direction of the front edge wall (4) by the inner tray (6), thereby being charged through the distribution port (9) of the application face (5) to an exterior. At the time of this discharge, the viscous cosmetic substance (3) is pushed out in the direction of an extension of the distribution port (9) diagonally to the application face (5). Thus, the viscous cosmetic substance (3) can be equally attached to a large area of the application face (5) and be applied smoothly and rapidly to the application target area such as the lips while being applied uniformly upon prevention of nonuniform application or the like of the viscous cosmetic substance (3), thereby enabling the application with a good finished quality.

Furthermore, since a discharge area of the viscous cosmetic substance (3) using the single distribution port (9) can be widened, the viscous cosmetic substance (3) can be discharged to a large area of the application face (5) even where the number of distribution ports (9) is relatively decreased, so that rough feeling or uncomfortable feeling, which the distribution port (9) gives to the application target area, can be decreased to give comfortable usability to the user. Furthermore, the number of distribution ports (9) can be decreased, thereby making it difficult to let external air, bacteria, and the like in through the distribution port (9), so that the viscous cosmetic substance (3) can be prevented from being oxidized or deteriorated as well as from dripping to the exterior when unused. Additionally, the opening (24) of the distribution port (9) at a side of the application face (5) may be formed by being subject to a round chamfering, so that an opening area can be further widened while contact with the application target area can be softened.

Fifth Embodiment

Figure 7:
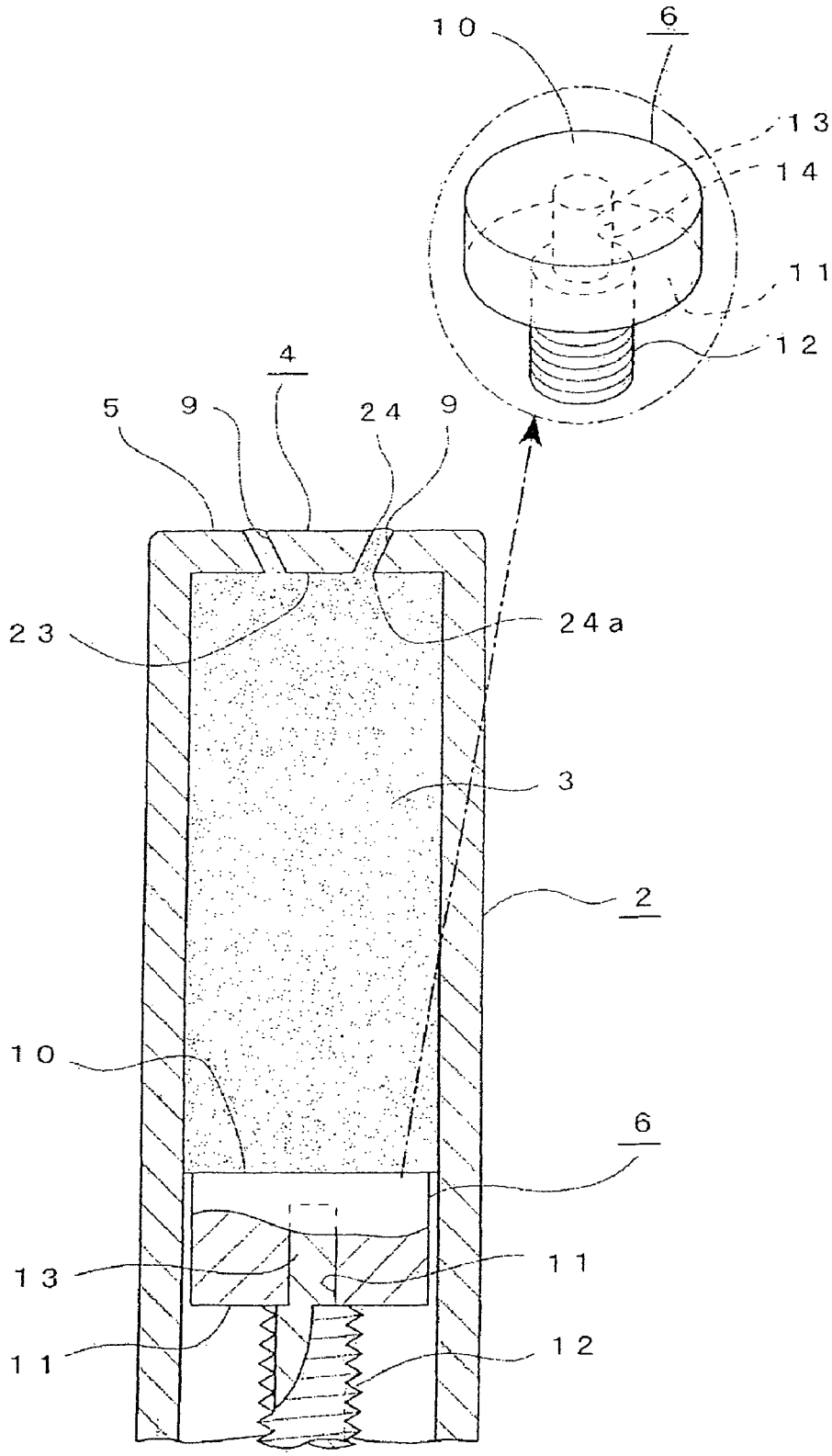
FIG. 7 is a cross-section of a viscous cosmetic substance container according to a fifth embodiment of this invention.

The fifth embodiment of this invention will be explained with reference to FIGS. 7 and 8. In the second and fourth embodiments, the front edge wall (4) is formed in an oval plane shape while being inclined with respect to the axial direction of the accommodation part (2). On the other hand, in the fifth embodiment, the front edge wall (4) is formed in a circular plane shape while being formed perpendicularly to the axial direction of the accommodation part (2). This front edge wall (4) is furnished with six distribution ports (9) in an arc shape. Furthermore, each of the distribution ports (9) is formed in a manner to incline the formation axis thereof with respect to the axial direction of the application face (5) and the accommodation part (2).

Furthermore, at the time of formation of six distribution ports (9) in an inclined manner, the opening (24) of each distribution port (9) at a side of the accommodation part (2) is placed near the center of the front edge wall (4) as shown in FIG. 8(*a*) the opening (24) at a side of the application face (5) is placed nearer the exterior in relation to the opening (24) at a side of the accommodation part (24). Six distribution ports (9) are radially opened from a side of the accommodation part (2) to a side of the application face (5).

The inner tray (6) in a tubular shape for pushing the viscous cosmetic substance (3) in the direction of the front edge wall (4) is placed in the accommodation part (2) in a slidable manner in the axial direction inside the accommodation part (2). The inner tray (6) is formed in manner to have the upper surface (10) at a side of the front edge wall (4) in parallel with the front edge wall (4) so the front edge shape of the inner tray (6) as to correspond to the inner surface (23) of the front edge wall (4) such that the upper surface (1) can come into contact with the inner surface (23) of the front edge wall (4) where the inner tray (6) is slid to a side of the front edge wall (4) to the maximum extent.

The inner tray (6) and the front edge wall (4) are in a tubular shape, thereby requiring neither alignment which is necessary for products according to the second and fourth embodiments, nor formation of the key flute (7) or the fitting piece (8), resulting in easy, inexpensive implementation.

In the fifth embodiment structured as described above also, the viscous cosmetic substance (3) inside the accommodation part (2) is pushed out to a wide area of the application face (5) from the center thereof in an external direction as shown in FIG. 8(*b*), through each of the plural distribution ports (9) radially disposed in a manner to incline the formation axis with respect to the application face (5), so that the viscous cosmetic substance (3) can be equally attached to a large area of the application face (5). As a result, the viscous cosmetic substance (3) can be applied smoothly and rapidly to the application target area such as the lips while preventing non-uniform application or the like, thereby enabling the application with a good finished quality.

Furthermore, since the inner tray (6) and the front edge wall (4) are in a tubular shape, the whole amount of the viscous cosmetic substance (3) accommodated in the accommodation part (2) can be discharged to the exterior through the distribution ports (9) by eventually bringing the upper surface (10) of the inner tray (6) into contact with the inner surface (23) of the front edge wall (4), thereby enabling economical use.

Sixth Embodiment

Next, the sixth embodiment of this invention will be explained with reference to FIGS. 9 to 12. First, in the second and fourth embodiments, the inner tray (6) and the front edge wall (4) formed in an inclined manner are aligned with each other by fitting the fitting piece (8) in the key flute (7) to eventually bring the upper surface (10) of the inner tray (6) into contact with the inner surface (23) of the front edge wall (4), thereby enabling the whole amount of the viscous cosmetic substance (3) inside the accommodation part (2) to be used up. In the case of formation of the key flute (7) and the fitting piece (8), however, there is a risk of increasing time and trouble required for manufacturing process or incorporation as well as a risk of decreasing hermeticity between the accommodation part (2) and the inner tray (6), thereby bringing a possibility of dripping in the case of accommodation of the viscous cosmetic substance (3) with a low viscosity.

To solve the aforementioned increase in hermeticity, the sixth embodiment has a structure capable of reliably aligning the inner tray (6) with the front edge wall (4) without formation of those key flute (6) and fitting piece (8). Furthermore, for the purpose of a further increase in hermeticity, a sealing member (25) made of soft or hard PE is formed to a base of the inner tray (6) at the opposite side of a side which comes in contact with the viscous cosmetic substance (3). The inner tray (6) is disposed in a slidable manner with respect to the sealing member (25) while the fitting projection (13) formed in a manner to project from the extension bar (12) is fit in a slidable manner into the fitting receiver (14) provided to the sealing member (25) and the inner tray (6).

Furthermore, where a shape of the inner tray (6) according to the sixth embodiment capable of sliding in the circumferential direction as described above is explained with reference to FIG. 12, an outer circumferential surface at a side of the base is formed in a tabular shape and an external diameter thereof is made substantially identical to an internal diameter of the accommodation part (2). A side of the front edge is formed in a tabular shape with a slightly small diameter than the base while an engaging stepped portion (26) in a tapered shape is symmetrically formed to an outer circumference of the inner tray (6).

Figure 9:
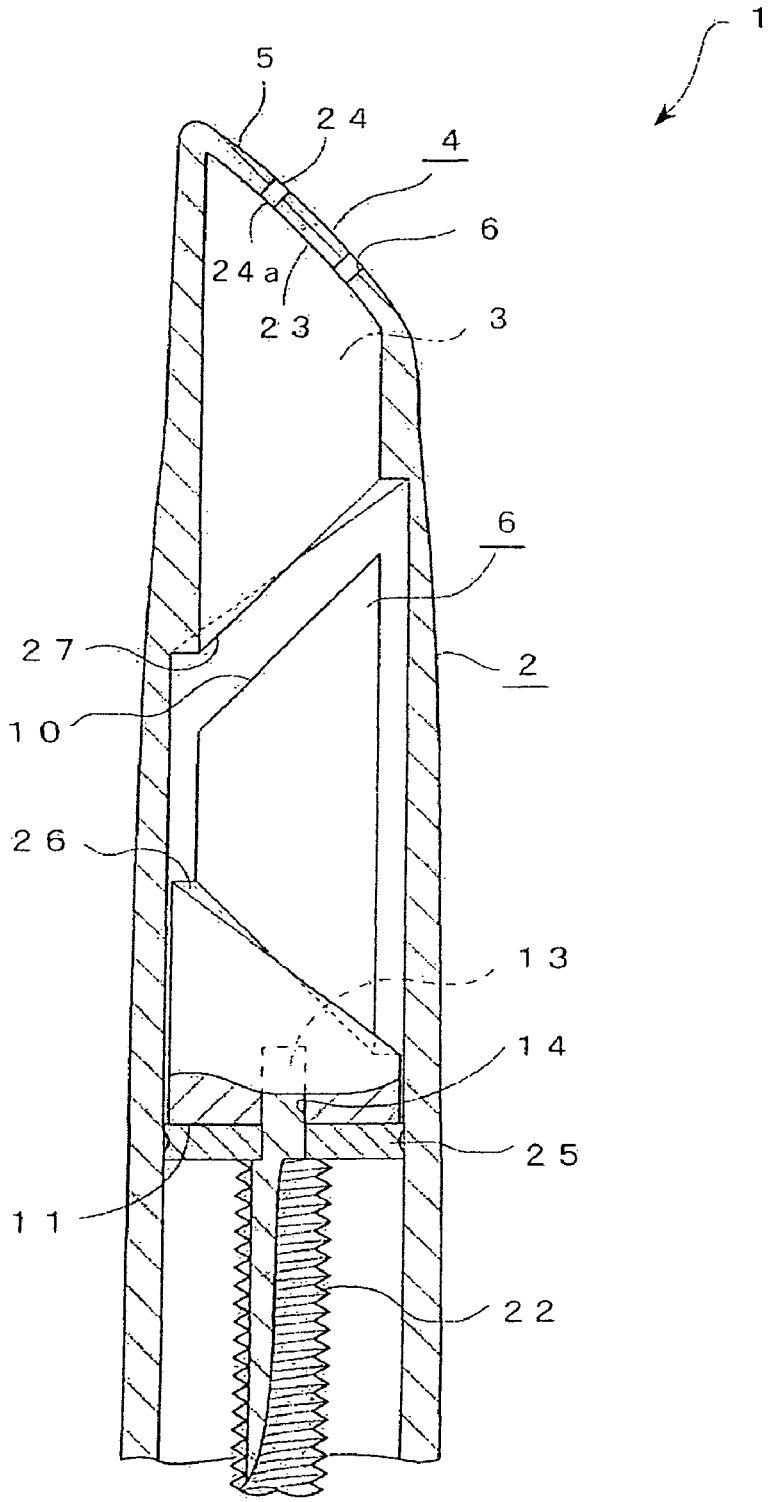
FIG. 9 is a cross-section view of a viscous cosmetic product according to a sixth embodiment of this invention.
Figure 10:
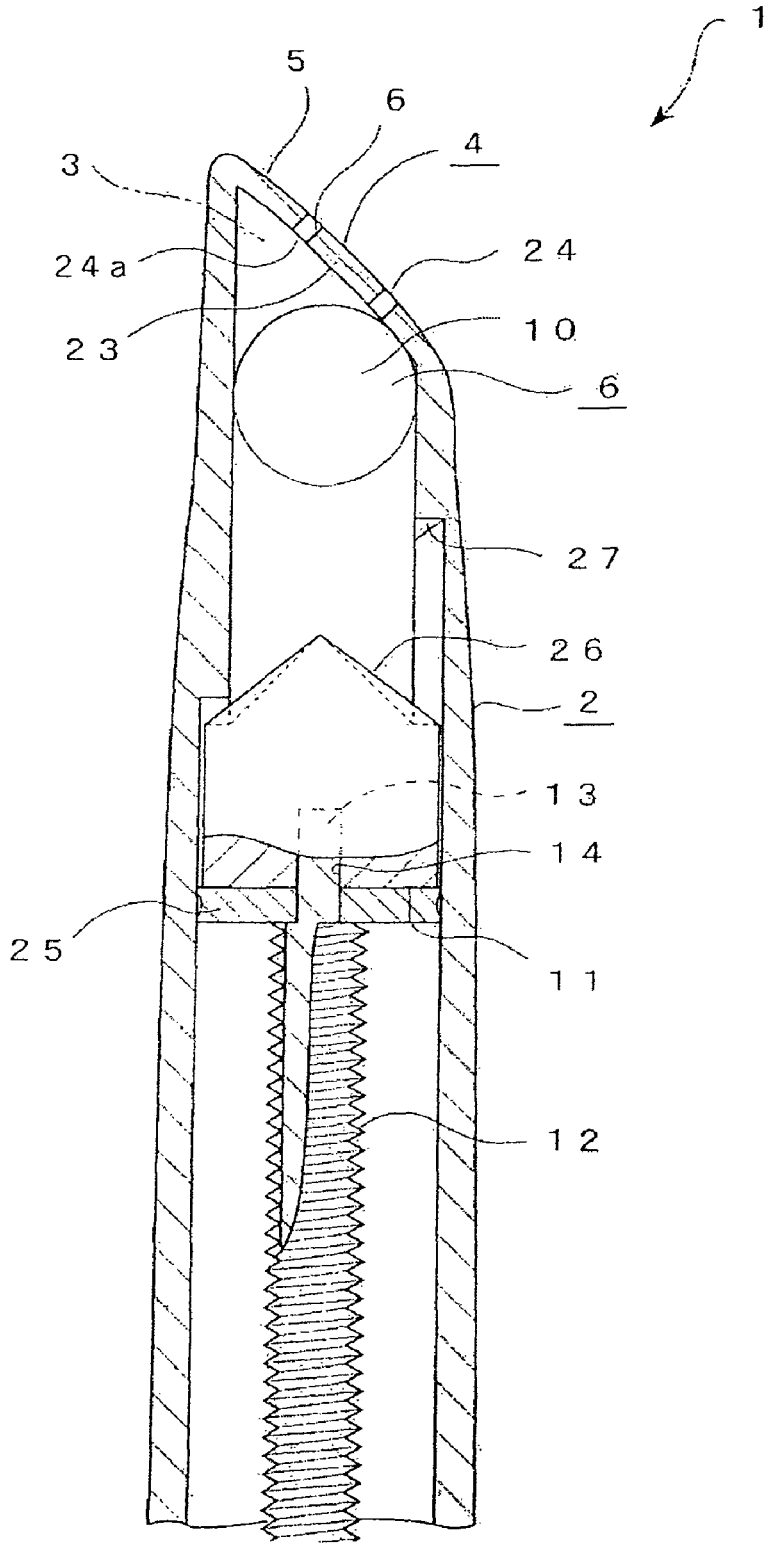
FIG. 10 is a cross-section view showing an engagement state between an engaging projection of an inner tray and a projection receiver of the accommodation part.
Figure 11:
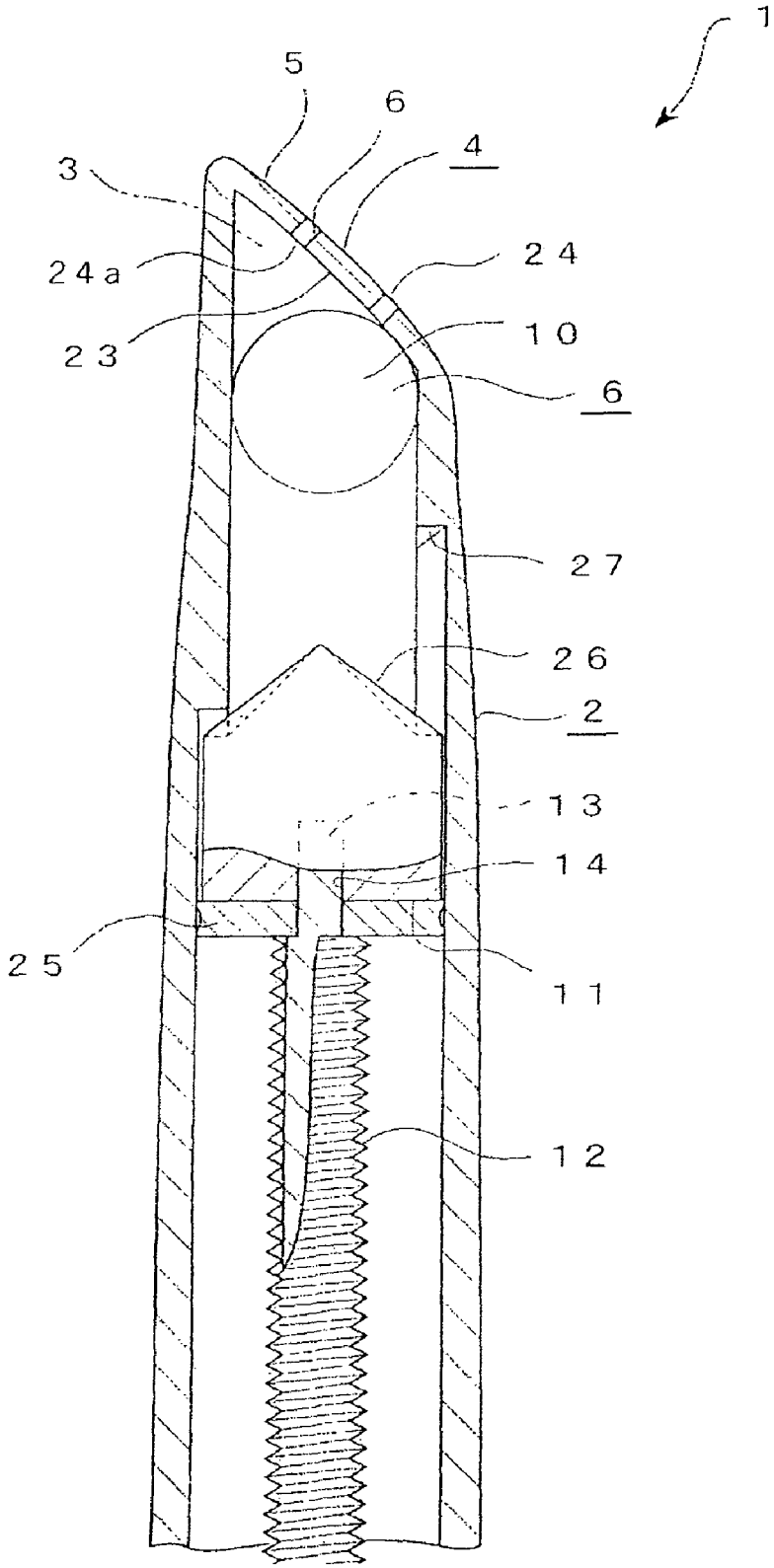
FIG. 11 is a cross-section view showing a process of correcting a position of the inner tray according to a sixth embodiment.

As shown in FIGS. 9 to 11, the step receiver (27) in engagement with the engaging stepped portion (26) in a corresponding manner is formed to an inner circumference of the accommodation part (2). As shown in FIG. 10, the engaging stepped portion (26) and the step receiver (27) can come in contact with each other at the time of bringing the upper surface (10) of the inner tray (6) into contact with the inner surface (23) of the front edge wall (4). In FIGS. 9 to 12, to make a shape and an engagement relation clear between the engaging stepped portion (26) and the step receiver (27), which will be described later, the viscous cosmetic substance (3) is omitted.

In the aforementioned viscous cosmetic substance container, since the alignment means as described above is formed, there is no necessity to make strict alignment so the inclinations of inner tray (6) and the front edge wall (4) as to be parallel to each other during manufacturing, so that inclination positions of the inner tray (6) and the front edge wall (4) may be opposite to each other as shown in FIG. 9. Therefore, there is no need for time and trouble required for strict alignment therebetween, resulting in improvement in production efficiency. Yet further, a base side of the inner tray (6) is formed in a tubular shape without projections and depressions and the sealing member (25) is disposed as this base side, so that hermeticity between the accommodation part (2) and the inner tray (6) can be improved, thereby being able to well prevent the viscous cosmetic substance (3) from dripping to a side of the extension bar (12).

Explained next is a mechanism for aligning the inner tray (6) in the case of misalignment between the front edge wall (4) and the inner tray (6) as shown in FIG. 9. First, where the inner tray (6) is shifted by rotatably moving the rotating body (17), the engaging stepped portion (26) of the inner tray (6) hits the step receiver (27) of the accommodation part (2) at the final stage of the viscous cosmetic substance (3) usage as shown in FIG. 10. Since the step receiver (27) and the engaging stepped portion (26) are formed in a shape each other tapering each other, the inner tray (6) shifts in the direction of the front edge wall (4) while rotatably moving in the circumferential direction along a tapered surface of the step receiver (27) in association with more rotatable movement of the rotating body (17). According to this rotatable movement, as shown in FIG. 11, a position of the inner tray (6) is gradually corrected correspondingly to a shape of the front edge wall (4), and thus the engaging stepped portion (26) and the step receiver (27) reliably engage with each other at last, thereby reliably bringing the upper surface (10) of the inner tray (6) in contact with the inner surface (23) of the front edge wall (4), so that the viscous cosmetic substance (3) can be used without waste.

Figure 12A:
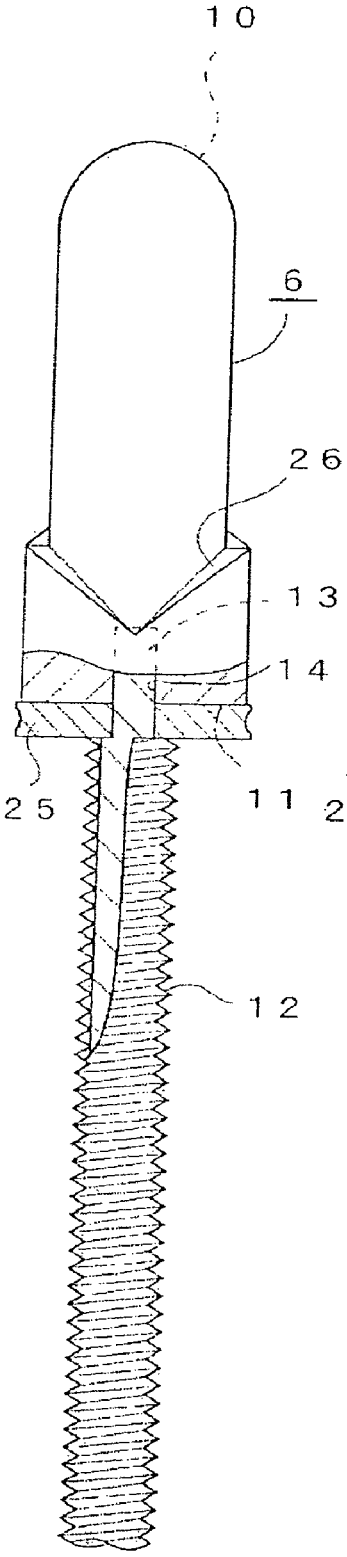
FIG. 12 illustrates a front view, a side view, and a back view of the inner tray and a sealing member according to the sixth embodiment.
Figure 12B:
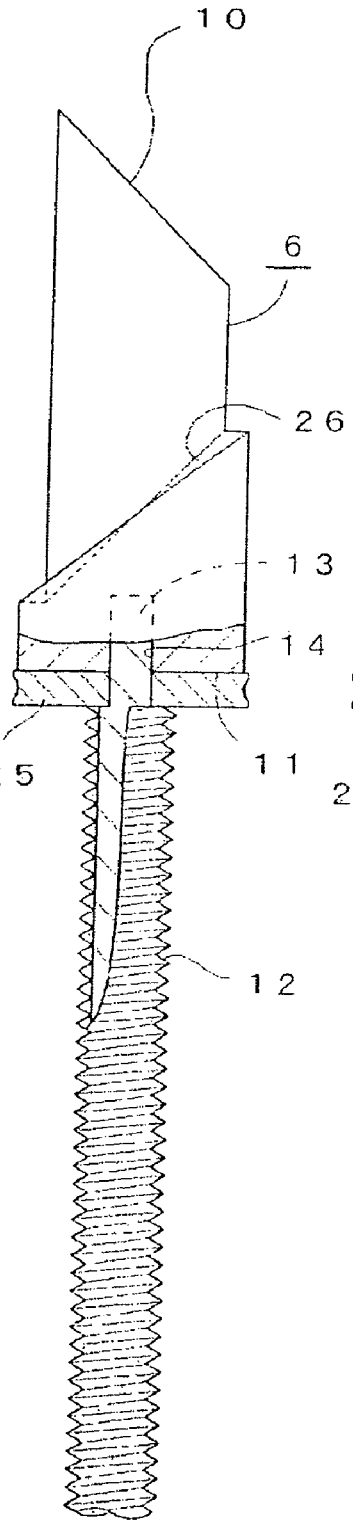
Figure 12C:
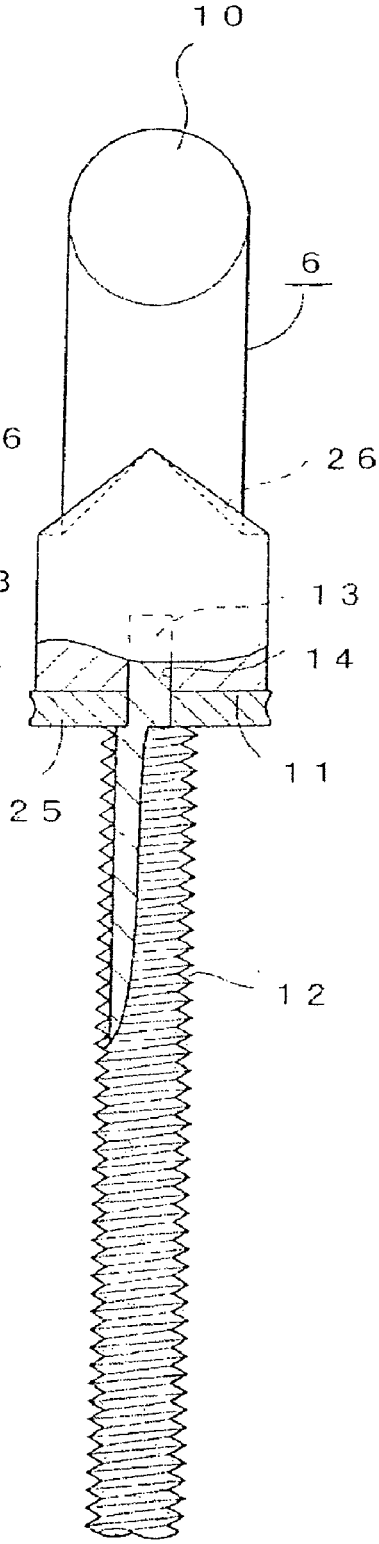

As shown in FIG. 12, furthermore, the engaging stepped portion (26) in a tapered shape is symmetrically formed at both sides of the inner tray (6), so that a resistance from the step receiver (27) is uniformly applied without being concentrated to one side, thereby enabling smooth rotatable movement and shift in the front edge direction without causing inclination of the inner tray (6). Furthermore, according to this symmetrical shape as well as a spiral direction of the outer circumferential spiral flute of the extension bar (12) and the inner circumferential spiral flute of the puncture (16), a position can be corrected because of rotatable movement of the inner tray (6) even where the inner tray (6) rotatably moves in either or both directions.

In a manner similar to the second, fourth, and sixth embodiments as described above, where the front edge wall (4) is formed in an inclined manner with respect to the axial direction of the accommodation port (2), it is desirable for the front edge wall (4) to have an inclination angle of 45 to 85 degrees between the axial direction of the application face (5) and the accommodation part (2). Furthermore, it is desirable to set a narrow-angle of 45 to 65 degrees between the front edge side of the application surface and the outer circumferential surface at the front edge side of the accommodation part (2). In the case where an inclination angle between the application face (5) and the axial direction of the accommodation part (2) is made smaller than 45 degrees, the angle of the application face (5) is so steep that the viscous cosmetic substance container (1) is used in an upright condition, thereby putting a burden on the arm or leading to a risk of dripping of the viscous cosmetic substance (3). Furthermore, in the case of the inclination angle larger than 85 degrees, the viscous cosmetic substance container (1) is awkwardly held up for use at the time of application of the viscous cosmetic substance (3) to the lower lip, thereby putting a burden to the arm as well as making visual check of the application target area through a mirror difficult.

In the case where the narrow-angle between the front edge of the application face (5) and the outer circumferential surface of the accommodation part (2) is smaller than 45 degrees, the outer circumferential surface of the front edge side of the accommodation part (2) is formed in a bent manner in the inner side direction of the accommodation part (2), so that the inner tray (6) cannot shift smoothly. Furthermore, in the case of the narrow-angle larger than 65 degrees, since the lip, the accommodation part (2), and the hand are overlaid while the user operates the application and visually checks the application target area through the mirror, it becomes difficult to confirm the application condition and to operate the application as well to determine a boundary between the front edge of the application face (5) and the outer circumferential surface of the accommodation part (2), thereby making it difficult especially to draw an outline with use of the front edge.

In the case of formation of the front end edge wall (4) in an inclined manner with respect to the axial direction of the accommodation part (2), a ridge line portion (28) between the application face (5) and a wall surface of the accommodation part (2) is formed desirably in an arc shape with a radius of curvature R of 0.3 mm to 3.0 mm to make resistance to the skin of the application target area such as the lip or the like soft, thereby enabling the viscous cosmetic substance (3) to be smoothly applied as well as to give comfortable usage to the user. In the case where this ridge line portion (28) is set to have a curvature radius smaller than R0.3 mm, such an effect cannot be obtained, as making resistance to the skin of the application target area. In the case of the curvature radius larger than R3.0 mm, the viscous cosmetic substance (3) of the application face (5) easily runs around a side surface of the accommodation part (2), thereby causing liquid dripping while having difficulty drawing the outline of the lips and the like clearly.

Herein, a value of application resistance to a surface area of the application face was measured at the time of application of the viscous cosmetic substance (3) to the application target area. The application resistance was measured by attaching the viscous cosmetic substance (3) of 0.02 g to a lower surface of the of a resin plate with an area as shown in Table 3, placing this resin plate on a urethane foam having an opaque film on a surface thereof, thereafter bringing a surface attached with the viscous cosmetic substance (3) to the urethane foam. The urethane foam was pulled in one direction in a situation where the resin plate was secured by application of a weight of 75 g, thereby detecting a resistance value with use of a tensile strength detector. It is to be noted that the amount of 0.02 g is the average amount of the viscous cosmetic substance (3) used for the lip. These experimental results are partially presented in Table 2 below.

TABLE 2

| | | | | | |
|---|---|---|---|---|---|
| area ($mm^2$) | 28 | 64 | 113 | 177 | 254 |
| diameter (mm) | 6Ø | 9Ø | 12Ø | 15Ø | 18Ø |
| resistance (N) | 0.433 | 0.767 | 0.933 | 1.067 | 1.167 |
| usage assessment | x liquid accumulation | ○ | ○ | Δ | x |

According to the results in Table 2, it is preferable that the application surface (5) have a surface area of 50 $mm^2$ to 150 $mm^2$, and smooth application becomes available while the uniform finished quality can be available without nonuniform application by increasing the application resistance at the time of bringing the application face (5) attached with the viscous cosmetic substance (3) into contact with the application target area. In the case of the surface area of the application face (5) narrower than 50 $mm^2$, application to the application part takes time and the viscous cosmetic substance (3) is attached to the application face (5) thickly, thereby causing drip accumulation to increase the application resistance as well as to cause nonuniform application to the lip. Furthermore, in the case of the surface area of the application face (5) wider than 150 $mm^2$, the viscous cosmetic substance (3) is spread on the application face (5) at the time of application, thereby resulting in the small amount of the attached viscous cosmetic substance per unit area and the large application resistance at the time of application on the lip, so that neither smooth application nor a sufficient amount of application can be conducted with the viscous cosmetic substance (3).

Seventh Embodiment

Figure 13:
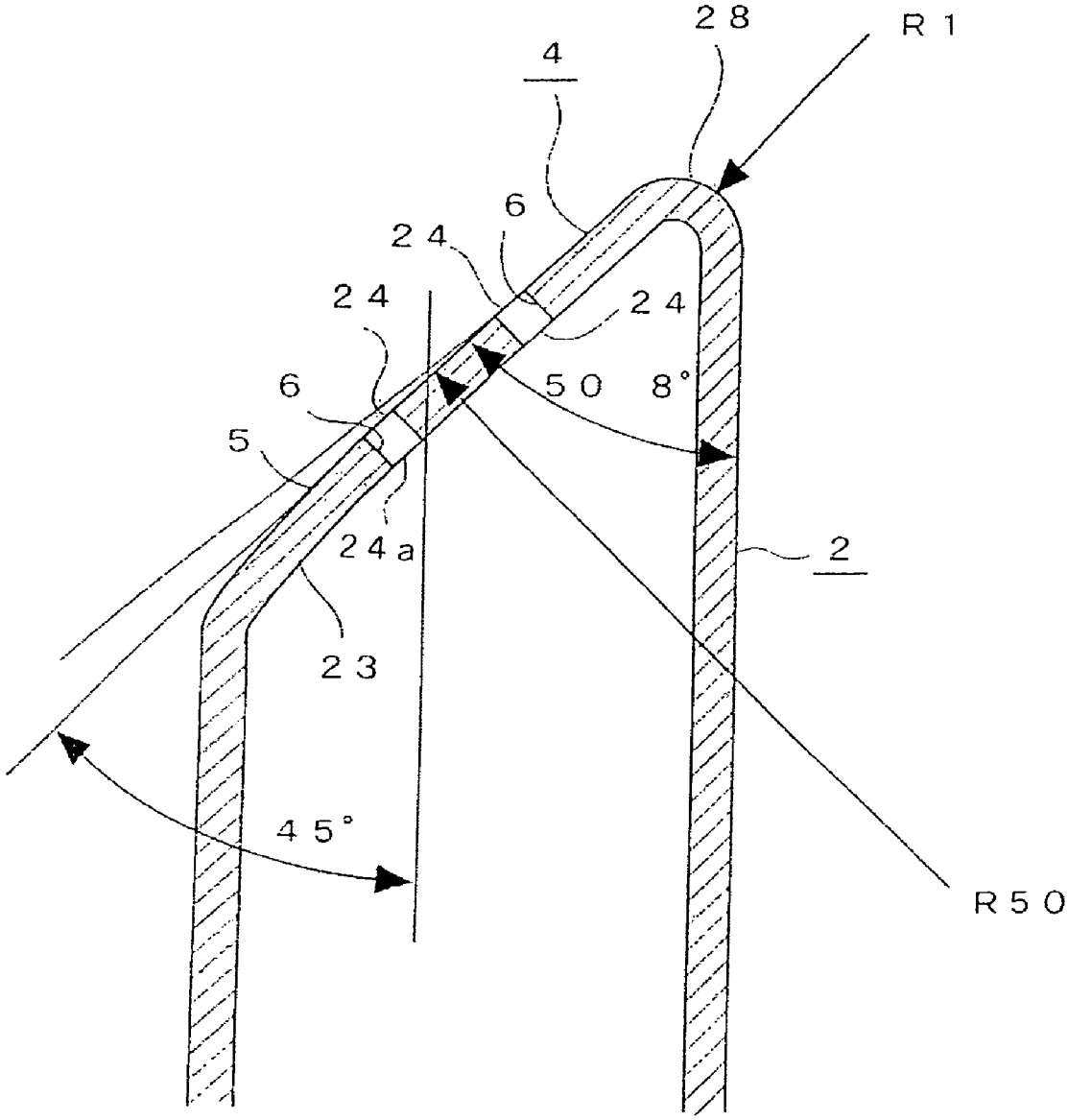
FIG. 13 is a partially-enlarged cross-section view of an accommodation part according to a seventh embodiment of this invention.

In consideration of a shape of R, a formation angle, a surface area, and the like with respect to the ridge line portion (28) of the application face (5), the preferred embodiment will be explained in the sixth embodiment shown in FIG. 13. First, the application face (5) is formed flat and an inclination angle of the application face (5) may be the same in whole, but the half at a front edge side and the half at a bear edge side may be formed with different inclination angles. Furthermore, in the first, second, fourth, fifth, and sixth embodiments as described above, the application face (5) is formed flat but may be formed as swelled outwardly in a circular shape to have a swelled surface.

Thus, in the seventh embodiment, the application face (5) of the front edge wall (4) is formed as a swelled surface in a circular shape with R of 50 mm. This application face (5) in a shape of a swelled surface having R of 50 mm is disposed in a manner that an inclination angle is set to 50.8 degrees with respect to the axial direction of the accommodation part (2) while being set to 45 degrees at a side of a lower edge. A ridge line portion (28) between the front edge side of the application face (5) and the wall surface of the accommodation part (2) is formed in a circular shape with curvature radius R 1.0 mm. The external diameter of the accommodation part (2) is set to 10 mm and the surface area of the application face (5) except a part of the ridge line portion (28) is set to 58 $mm^2$.

With the application face (5), the application resistance increases at the time of contact with the lip, thereby enabling the smooth application of the viscous cosmetic substance (3) to the lip. Furthermore, where the application face (5) is formed as a swelled surface in a circular shape as described in this embodiment, or as a flat surface, the viscous cosmetic substance (3) barely remains on the application face (5) after use to enable cleaner use, compared with the case where the application face (5) is formed as a dented surface.

In the case of application of the viscous cosmetic substance (3) to the lower lip, the application can be operated smoothly and easily by bringing a side of the application face (5) into contact with a side having an inclination angle of 45 degrees. On the other hand, in the case of application of the viscous cosmetic substance (3) to the lower lip, the front edge side, which has a gentle inclination angle corresponding to an angle of the upper lip, can be easily brought into contact with the upper lip for application of the viscous cosmetic substance (3). Therefore, where the viscous cosmetic substance (3) is applied to the upper lip and the lower lip one after the other in turns, the application can be switched only by changing a position of the application face (5) to be brought into contact, thereby enabling the easy, smooth application operation without necessity of adjusting a holding angle of the viscous cosmetic substance container (1). Accordingly, using the front edge of the R-shape of the application face (5), it becomes easy to draw an outline on the upper lip while contact sensing becomes soft.

Eighth Embodiment

Figure 14:
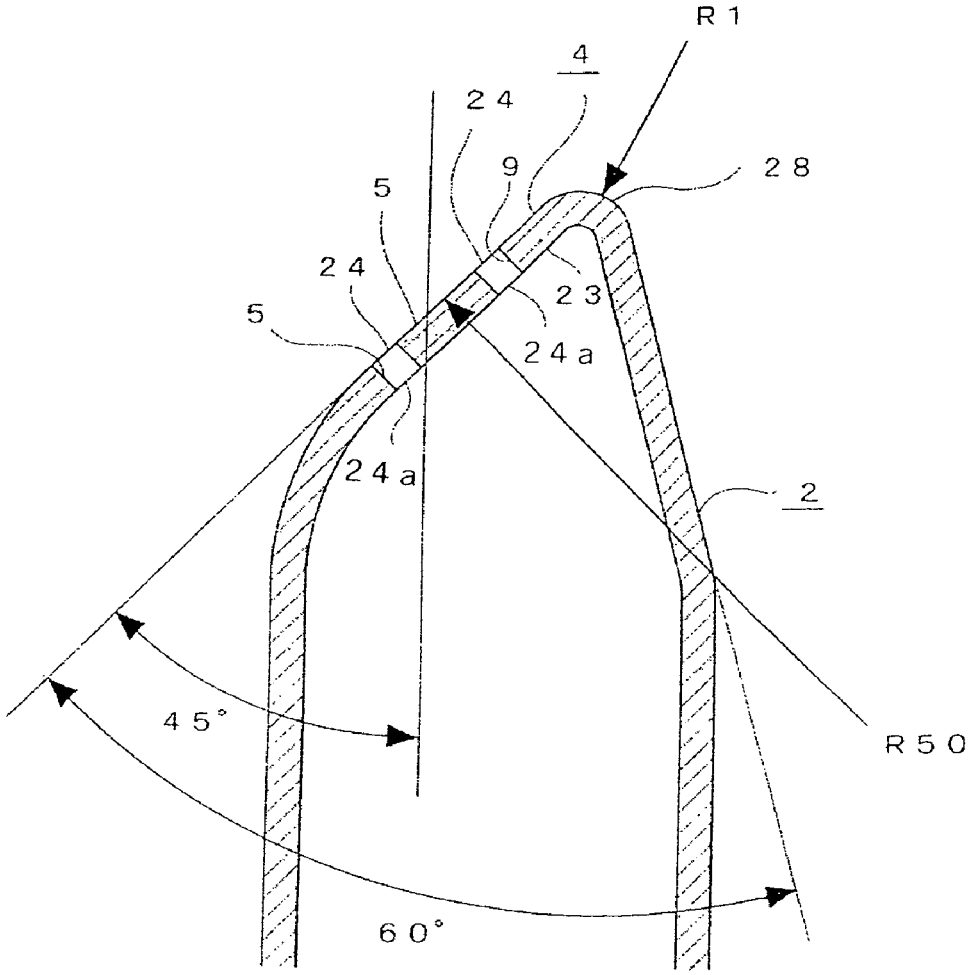
FIG. 14 is a partially-enlarged cross section view of an accommodation part according to an eighth embodiment of this invention.

Next, the eighth embodiment as another different preferred embodiment will be explained with reference to FIG. 14. In the eighth embodiment also, the application face (5) is formed as a swelled surface in a circular shape, and the inclination angle between application face (5) and the axial direction of the accommodation part (2) is set to 45 degrees. Furthermore, the outer circumferential surface of the accommodation part (2) is formed in parallel with the axial direction in the seventh embodiment and others, but a side wall surface at the front edge wall is formed in a tapered shape so the front end side as to be inclined outwardly. The narrow angle between the side wall surface in a tapered shape and the application face (5) is set to 60 degrees while the ridge line portion (28) is formed in a circular shape with R of 1.0 mm and the surface area, except a part of the ridge line portion (28), is set to 52 $mm^2$.

With the viscous cosmetic substance container (1) as described above, the viscous cosmetic substance (3) can be applied smoothly by decreasing the application resistance with use of the application face (5) shaped as a swelled surface. Furthermore, formation of the side wall surface at the front edge side of the accommodation part (2) barely has the wall surface of the accommodation part (2) or the hand coming in sight while the application face (5) is in contact with the upper lip, so that the user can apply the viscous cosmetic substance (3) easily while checking the lip and it becomes easy to draw the outline.

In the sixth, seventh, and eighth embodiments, the distribution port (9) formed at the application face (5) is formed in a manner such that the formation axis is approximately perpendicular to the application face (5), as shown in each drawing, but the distribution port (9) may be formed in a manner such that that the formation axis is inclined with respect to the application face (5).

Ninth Embodiment

Figure 15:
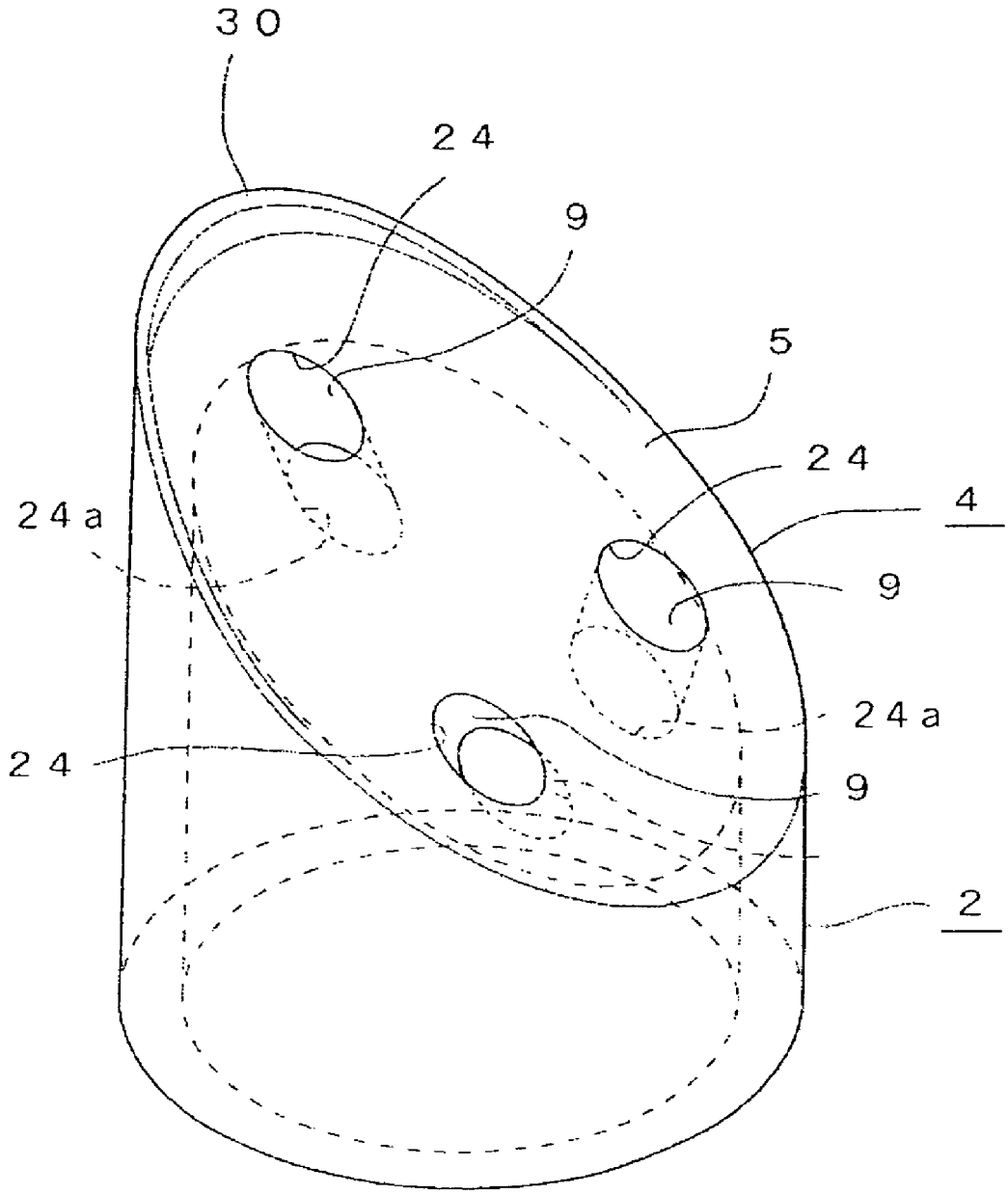
FIG. 15 is a partially-enlarged cross section view of an accommodation part according to a ninth embodiment of this invention.

Furthermore, the ninth embodiment will be explained with reference to FIG. 15. In the ninth embodiment, the front edge wall (4) is formed in an inclined manner with respect to the axial direction of the accommodation part (2) while the application face (5) is formed in an oval plane shape. Three distribution ports (9) for discharging the viscous cosmetic substance (3) to the application face (5) are opened in the front edge wall (4), in a manner such that the formation axis is inclined with respect to the axial direction. In this embodiment, furthermore, the half of an outer circumference of the front edge side of the application face (5) is formed in a projected manner to the front edge wall (4) to form an outer circumferential wall (30).

As described above, upon formation of the outer circumferential wall (30), the viscous cosmetic substance (3) on the application face (5) is blocked by the outer circumferential wall (30), thereby making it easy to draw the outline of the lip clearly. Furthermore, the formation of the front edge of the outer circumferential wall (30) makes contact sensing soft.

Accordingly, the outer circumferential wall (30) is formed in a projected manner with a formation height of 0.1 mm to 0.2 mm. In the case of the height lower that 0.1 mm, the amount of the viscous cosmetic substance (3) remaining at a side of the outer circumferential wall (30) is too small to obtain an effect such as drawing the outline clearly. Furthermore, in the case of the formation height higher than 0.2 mm, the amount of the viscous cosmetic substance (3) remaining at the outer circumferential wall (30) becomes large enough to cause excessively thick application or nonuniform application, resulting in an unsanitary condition. Yet further, the outer circumferential wall (30) hits the lip, thereby degrading contact sensing or making it difficult to bring the application face (5) into contact with the lip.

Tenth Embodiment

Figure 16A:
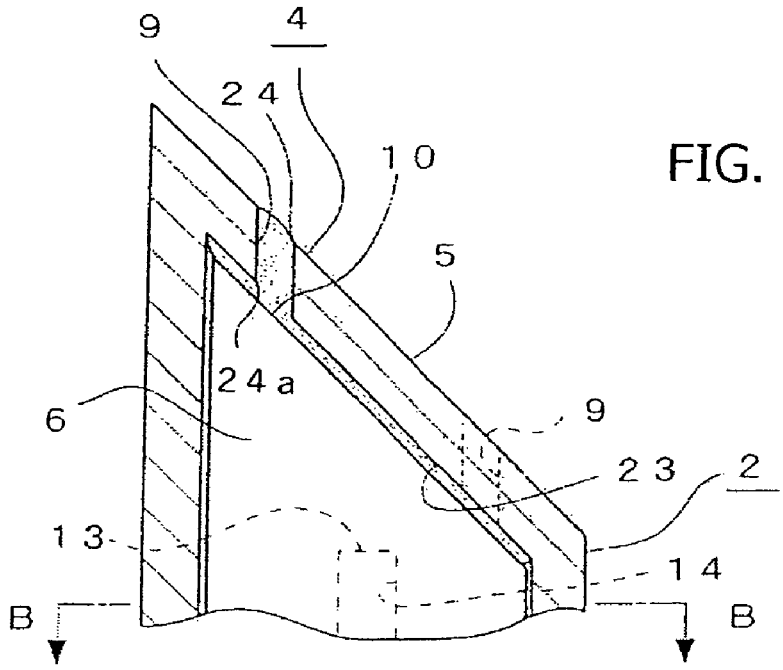
FIG. 16(*a*) is an enlarged cross-section view of an accommodation part and an inner tray according to a tenth embodiment of this invention and FIG. 16(*b*) is a cross-section view of FIG. 16A along the line B-B.
Figure 16B:
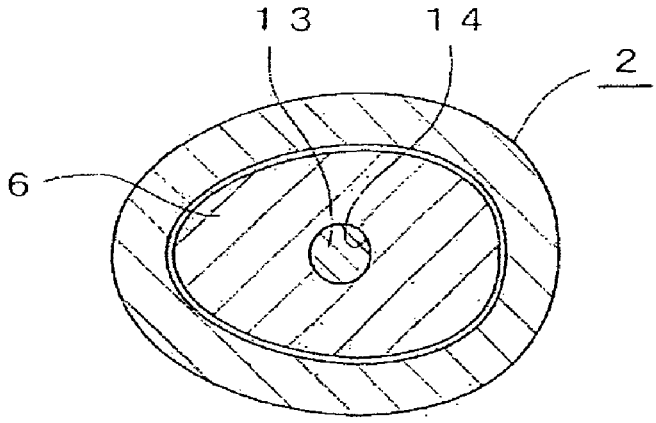

Next, the tenth embodiment as another different embodiment will be explained with reference to FIG. 16, which is provided with a mechanism for preventing the inner tray (6) from rotatably moving in the circumferential direction. For this prevention of the rotatable movement, the fitting piece (8) formed in a projected manner to the accommodation part (29) is fit into the key flute formed to the inner tray (6) in the second and fourth embodiments. On the other hand, in this embodiment, a cross-sectional shape of squareness in the axial direction between the accommodation part (2) and the inner plate (6) is formed in a noncircular shape such as an ellipse or an oval, as shown in FIG. 17(*a*). With a structure as described above, the inner tray (6) can be prevented from rotatably moving in the circumferential direction by making the inner tray (6) hit the inner wall surface of the accommodation part (2). Since neither the key flute (7) nor the fitting piece (8) is formed, components can be easily shaped or incorporated while the hermeticity in the accommodation part (2) can be improved.

In each of the embodiments described above, it is preferable that the application face (5) be formed as a flat and smooth surface with average surface roughness Ra of 1 nm to 100 μm. In the case of the average surface roughness Ra smaller than 1 nm, it becomes technically difficult to manufacture the application face (5) with a metallic mold. In the case of Ra larger than 100 μm, the viscous cosmetic substance (3) easily remains on the surface, thereby making usage in sanitary condition difficult, resulting in a problem for a hygienic reason. Furthermore, in the case of making the accommodation part (2) transparent or semitransparent, the viscous cosmetic substance (3) can be easily understood with respect to physical properties such as a color or gloss while an application texture becomes smooth and in a good condition.

The viscous cosmetic substance (3) is exemplified as a chapstick in the tenth embodiment, the first to the ninth embodiments, and the blending examples but is not limited to the chapstick in other different embodiments and blending examples and a base for the chapstick, a liquid chapstick, a liquid foundation, liquid cream, and other viscous cosmetic substance (3) may be used.

What is claimed is:

1. A viscous cosmetic product comprising:

an accommodation part in a tubular shape accommodating a viscous cosmetic substance having the form of a solid bar containing 1.0 to 10.0 wt % of silicic anhydride;

an application face formed at an outer side of a front edge wall integrally formed on the accommodation part, the application face having at least one distribution passage for the viscous cosmetic substance; and an inner tray for pressing the viscous cosmetic substance accommodated in the accommodation part to push the viscous cosmetic substance to an exterior through the distribution passage, the inner tray incorporated in the accommodation part.

2. The viscous cosmetic product according to claim 1, wherein an initial particle of silicic anhydride has an average diameter of 5.0 to 30 nm.

3. The viscous cosmetic product according to claim 1, wherein the silicic anhydride is such as having been subject to a silylation process.

4. The viscous cosmetic product according to claim 1, wherein the viscous cosmetic substance has a hardness 5 to 30 as a measured value by a Rheometer at 25 degrees Celsius (Rheometer 11.3 Ø25 degrees Celsius, manufactured by Fudo Kogyo Co., Ltd.).

5. The viscous cosmetic product according to claim 1, wherein the distribution passage is formed in a manner inclined to a formation axis with respect to the application face.

6. The viscous cosmetic product of claim 5, wherein the application face has a plurality of distribution passages.

7. The viscous cosmetic product according to claim 1 or claim 5, wherein the distribution passage has an opening at a side of the accommodation part, placed near a center of the front edge wall and an opening at a side of the application face, placed nearer the exterior in relation to the opening at the side of the accommodation part so that the viscous cosmetic substance can be radially expelled through the distribution passage to the application face from the center in the external direction.

8. The viscous cosmetic product according to claim 1, wherein the application face resides in a plane that is entirely inclined relative to a longitudinal axis of the accommodation part.

9. The viscous cosmetic product of claim 8, wherein the application face has a plurality of distribution passages.

10. The viscous cosmetic product of claim 1, wherein the application face has a plurality of distribution passages.

11. The viscous cosmetic product according to claim 10 or claim 6, wherein the distribution passages have an opening at a side of the accommodation part, placed near a center of the front edge wall and an opening at a side of the application face, placed nearer the exterior in relation to the opening at the side of the accommodation part so that the viscous cosmetic substance can be radially expelled through the distribution passages to the application face from the center in the external direction.

* * * * *